US012123300B2

(12) United States Patent
Fellinghaug et al.

(10) Patent No.: US 12,123,300 B2
(45) Date of Patent: Oct. 22, 2024

(54) METHOD AND APPARATUS FOR WIRELESS COMMUNICATION IN WELLS USING FLUID FLOW PERTURBATIONS

(71) Applicant: WiDril AS, Trondheim (NO)

(72) Inventors: Jarl André Fellinghaug, Trondheim (NO); Vegard Fiksdal, Trondheim (NO); Anton Kulyakhtin, Trondheim (NO)

(73) Assignee: WiDril AS, Trondheim (NO)

( * ) Notice: Subject to any disclaimer, the term of this patent is extended or adjusted under 35 U.S.C. 154(b) by 0 days.

(21) Appl. No.: 18/162,651

(22) Filed: Jan. 31, 2023

(65) Prior Publication Data

US 2024/0003248 A1 Jan. 4, 2024

Related U.S. Application Data

(63) Continuation of application No. 17/808,506, filed on Jun. 23, 2022, now abandoned, which is a (Continued)

(51) Int. Cl.

| | |
|---|---|
| ***E21B 47/18*** | (2012.01) |
| ***E21B 41/00*** | (2006.01) |
| ***E21B 47/06*** | (2012.01) |

(52) U.S. Cl.

CPC ..... *E21B 47/18* (2013.01); *E21B 41/0085* (2013.01); *E21B 47/06* (2013.01)

(58) Field of Classification Search

CPC ..... E21B 47/18; E21B 41/0085; E21B 47/06; E21B 47/14; H04L 25/0254; H04L 5/023

See application file for complete search history.

(56) References Cited

U.S. PATENT DOCUMENTS

| | | | |
|---|---|---|---|
| 4,733,232 | A | 3/1988 | Grosso |
| 4,782,695 | A | 11/1988 | Glotin et al. |

(Continued)

FOREIGN PATENT DOCUMENTS

| | | | |
|---|---|---|---|
| WO | WO2018/119520 | A1 | 7/2018 |
| WO | WO2018/217506 | A1 | 11/2018 |
| WO | WO 2020/172468 | A1 | 8/2020 |

OTHER PUBLICATIONS

Downhole Power Generation and Wireless Communications For Intelligent Completion Applications; https://netl.doe.gov/node/3815; National Energy Technology Laboratory; in 5 pages.

(Continued)

*Primary Examiner* — Nader Bolourchi

(74) *Attorney, Agent, or Firm* — Knobbe, Martens, Olson & Bear, LLP

(57) ABSTRACT

Disclosed are perturbation signaling systems and methods for use in a downhole well. Such systems can include a downhole tool configured to hang from a wellbore anchoring mechanism. The tool can have or associate with an energy harvesting system, a power management system, a sensing system, and a wireless communication system. A turbine generator can encode signals into flowing fluid through electric load and related changes in hydraulic energy, transmitting information through the fluid. A receiver station positioned at another well location can decode and or relay the signals. Signals can bypass impediments such as noise zones by inducing signals in adjacent parallel well environments such as an annulus. The receiver station can accumulate energy from repeated redundant signaling over time to enhance communication and signal resolution. An additional wireless communication system can receive and/or relay data to a remote location.

23 Claims, 16 Drawing Sheets

Related U.S. Application Data continuation of application No. 16/796,637, filed on Feb. 20, 2020, now Pat. No. 11,414,987.

(60) Provisional application No. 62/916,121, filed on Oct. 16, 2019, provisional application No. 62/808,755, filed on Feb. 21, 2019.

(56) References Cited

U.S. PATENT DOCUMENTS

| | | | |
|---|---|---|---|
| 5,329,811 | A | 7/1994 | Schultz et al. |
| 5,799,733 | A | 9/1998 | Ringgenberg et al. |
| 6,899,178 | B2 | 5/2005 | Tubel |
| 7,124,819 | B2 | 10/2006 | Ciglenec et al. |
| 7,234,521 | B2 | 6/2007 | Shammai et al. |
| 8,169,854 | B2 | 5/2012 | Godager |
| 8,284,075 | B2 | 10/2012 | Fincher et al. |
| 9,670,775 | B2 | 6/2017 | Tjhang et al. |
| 10,100,635 | B2 | 10/2018 | Keller et al. |
| 10,287,880 | B2 | 5/2019 | Indo et al. |
| 10,316,650 | B2 | 6/2019 | Irani |
| 2003/0192692 | A1 | 10/2003 | Tubel |
| 2005/0257611 | A1 | 11/2005 | Fogal et al. |
| 2007/0030762 | A1 | 2/2007 | Huang et al. |
| 2010/0132941 | A1 | 6/2010 | van Zuilekom et al. |
| 2013/0341094 | A1 | 12/2013 | Taherian et al. |
| 2015/0009039 | A1 | 1/2015 | Tinnen et al. |
| 2016/0215615 | A1 | 7/2016 | Gorrara |
| 2016/0290847 | A1 | 10/2016 | Gronsberg et al. |
| 2017/0284198 | A1 | 10/2017 | Pop et al. |
| 2018/0058202 | A1 | 3/2018 | Disko et al. |
| 2018/0340413 | A1 | 11/2018 | Shah |
| 2019/0249549 | A1 | 8/2019 | Fripp et al. |
| 2019/0353031 | A1 | 11/2019 | Logan |

OTHER PUBLICATIONS

Downhole Wireless Technology For Production; https://www.tendeka.com/technical-articles/downhole-wireless-technology-for-production/; Tendeka; in 6 pages.

International Search Report/Written Opinion dated Jul. 22, 2020; in international application no. PCT/US2020/019119; filed Feb. 20, 2020; 23 pages.

International Preliminary Report on Patentability dated Aug. 10, 2021; in international application No. PCT/US2020/019119; filed Feb. 20, 2020; 12 pages.

METHOD AND APPARATUS FOR WIRELESS COMMUNICATION IN WELLS USING FLUID FLOW PERTURBATIONS

CROSS-REFERENCE TO RELATED APPLICATIONS

This application is a Continuation of U.S. application Ser. No. 17/808,506, titled "METHOD AND APPARATUS FOR WIRELESS COMMUNICATION IN WELLS USING FLUID FLOW PERTURBATIONS", filed on Jun. 23, 2022, which is a continuation of U.S. application Ser. No. 16/796,637, titled "METHOD AND APPARATUS FOR WIRELESS COMMUNICATION IN WELLS USING FLUID FLOW PERTURBATIONS", filed on Feb. 20, 2020, which claims the benefit under 35 U.S.C. § 119(e) of U.S. Provisional Application No. 62/916,121, titled "METHOD AND APPARATUS FOR WIRELESS COMMUNICATION IN WELLS USING INDUCED PERTURBATIONS", filed on Oct. 16, 2019, and claims the benefit under 35 U.S.C. § 119(e) of U.S. Provisional Application No. 62/808,755, titled "METHOD AND APPARATUS FOR WIRELESS COMMUNICATION IN WELLS USING INDUCED PERTURBATIONS", filed on Feb. 21, 2019; Any and all applications for which a foreign or domestic priority claim is identified in the Application Data Sheet of the present application are hereby incorporated by reference under 37 CFR 1.57. The entire disclosure of each of the above-identified applications is incorporated by reference herein and made part of this specification, for all purposes, for all that each contains.

FIELD

This disclosure relates to a method and apparatus of wirelessly communicating information between well locations (e.g., from a downhole tool to a surface or subsea located receiver station or between downhole tools).

BACKGROUND

Downhole gauges can help measure characteristics (e.g., pressure and temperature) of an oil or other well (e.g., oil, gas, water, producer or injector well). Some existing systems use Tubing Enclosed Cable (TEC) to provide power and communication between a downhole gauge and a surface installation, but typical TEC installations are prone to failure and damage over time. This can lead to significant delays and other problems.

SUMMARY

This disclosure describes new solutions that can help provide timely downhole data for well testing and long-term monitoring, for example. Retrofit, retrievable, wireless gauge systems and methods are described.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

Figure 1:
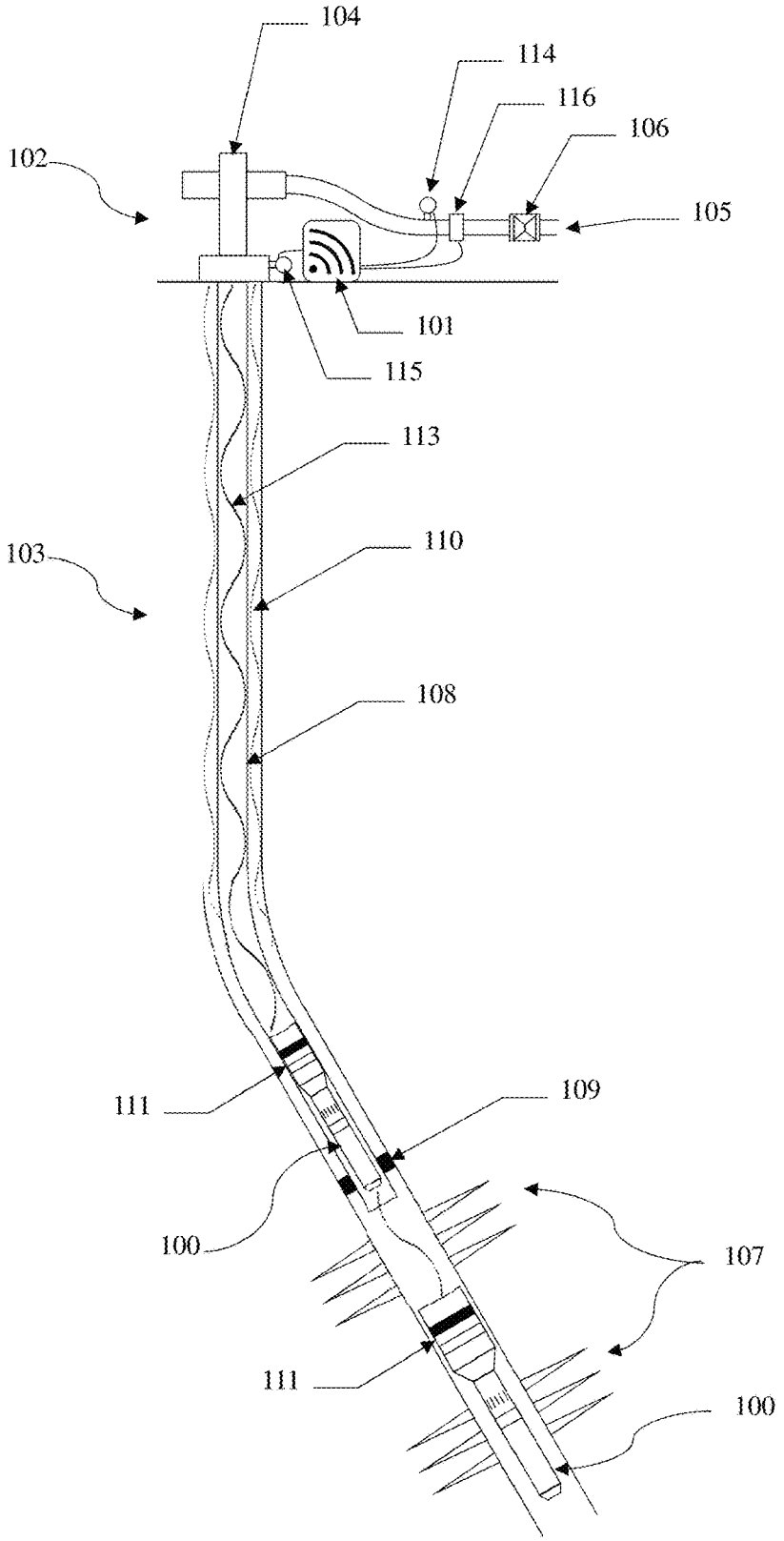
FIG. 1 is a schematic illustration of downhole tool(s) and a surface receiver unit in a wellbore.

This disclosure relates to methods and apparatus for wirelessly communicating information from and to well locations. For example, signals can be transmitted from a downhole tool to a surface or subsea-located receiver station. The downhole tool can use flowing fluid (e.g., the production flow in a producing well or water flowing in an injection well) as an energy provider and a communication channel to another well location (e.g., another downhole tool, the surface-located receiver station, etc.). The downhole tool can in different applications be measuring downhole conditions such as pressure, temperature, and flow rates, giving valuable information to reservoir and production engineers. The downhole tool and surface or subsea equipment is intended to be easily installed, both as a new installation and in a retrofit application, both for short duration well tests and for long term production and reservoir monitoring. The methods and systems described can also be used for control, to pass information between downhole tools, etc.

Reservoir and production data can be key information for reservoir and production engineers to fully understand how to successfully produce and deplete a field. In some newer fields, permanent downhole gauges may be installed to measure pressure and temperature for long term monitoring. These systems often use a Tubing Enclosed Cable (TEC) to provide power and communication between the downhole gauge and the surface installation. The TEC is usually clamped on to the outside of the production tubing in an upper portion of a well between the downhole-located gauge and the surface. These TEC installations is very often prone to failure, often due to corrosion, damage that occurs during installation of the tubing, or fluid ingress into the connections or into the cable itself. Usually, the only option to resolve a faulty TEC or downhole gauge is to recomplete the well, which involves bringing a rig to the wellsite, pulling up the production tubing, reinstalling new TEC clamped to the tubing and carefully installing the production tubing again. This is a very costly and time-consuming effort for onshore wells, and an extreme effort in most offshore subsea wells. The usual outcome of a faulty wired downhole gauge is that the gauge remains faulty, so reservoir and production engineers are required to operate the well with very limited data to support their depletion strategy and decisions.

In many other fields where permanent downhole gauges are not installed, well tests are performed with memory gauges installed on gauge hangers. A well test can typically facilitate multiple runs in a wellbore over several days with a gauge hanger at different depths and where the well is subjected to different flowing regimes, while pressure and temperature conditions are recorded. The success rates for conventional well testing methods, which rely on data from memory gauges, can be challenging. For example, available data may not cleanly correlate the timing and position of the gauge when a given set of stored data was collected. Thus, one may not know if the memory gauges have captured the information before or after the gauges have been pulled out of the wellbore. Several days may have been spent subjecting the well to different flowing regimes, and from time to time the results are not effectively captured due to a faulty memory gauge or wrong settings, or due to the fact that the subjected flow regimes were not correctly applied. An important difference between running a memory-gauge-based well test compared to a wired-permanent-downhole gauge, is the time element. A wired permanent downhole gauge can provide relatively real-time (updated, current) information on the downhole conditions and may save days of operational time over the alternative approaches for performing the necessary well tests. (In this application, real-time can refer to information that is provided on the same day, within the same hour, or within the same minute, that the measured condition occurred. Real time data can refer to any data provided by a sensor that is already present down hole, without requiring a pause or delay in production activities to install a sensor.) However, wired permanent downhole gauges are not always a reliable solution because they often fail due to wire breach or other problems, as discussed above.

A new solution is needed for obtaining real time downhole data for well testing and long-term monitoring. Preferably, the solution does not rely on problematic TEC options or an expensive installation method of recompleting the well. A retrofit, retrievable, wireless gauge approach is needed.

The new solution preferably overcomes one or more of the deficiencies and provides one or more benefits discussed herein.

Benefits include the ability to be retrofit to an existing well and/or to be deployable using slickline or wireline methods in the wellbore. Useful solutions can anchor in wellbore and be retrievable (e.g., by allowing anchoring mechanisms to be pullable by slickline or wireline methods). Fully wireless options for a downhole tool may employ self-sustained power system(s) for long term downhole operation and a wireless communication method to transmit information between well locations (e.g., from the downhole location, to another downhole location, to a surface or subsea receiver, etc.).

There have been several attempts to wirelessly communicate information along wellbores. One attempt is described in U.S. patent application Ser. No. 14/377,377 A1 (Tinnen, Sortveit) which discloses a flow controlling device to transmit pressure-based pulses which can be read as signals at another location. This disclosure is very similar to Measure While Drilling (MWD) telemetry systems, where a mud choke is used as a flow controlling device to transmit rudimentary, large-scale pressure pulses in the flow line between two locations. A drawback to using this and similar MWD-telemetry-based systems in a flowing (e.g., production or injector) well is that this can only be used for naturally flowing wells and not wells that require artificial lift, like Progressive Cavity Pumps (PCP) or Electric Submersible Pumps (ESP). Such systems will kill (e.g., override, block, interrupt, drown out, or otherwise thwart or undermine) the pressure based signals. Another drawback is that the field production rate is quantified by a reservoir's flowing pressure in the wellbore, so creating large and long-lasting downhole restrictions (e.g., using a mud choke) severely impacts a well's production rate. Some example case studies of these drawbacks found on Tendeka's website (Assignee of U.S. Ser. No. 14/377,377 A1) show downhole pressure losses exceeding 10 Bar (150 psi) for the majority of the test duration.

The present disclosure describes a method and apparatus of a downhole tool and a surface or subsea receiver station for a retrofit, retrievable wireless gauge system. A downhole tool can be hung off a wellbore anchoring mechanism, like a lock mandrel, a gauge hanger or a flow-through plug, all of which can be installed with techniques such as slickline, wireline, coiled tubing, or tubing deployed methods. The downhole tool can have one or more of an energy harvesting systems, a power management and storing system, a sensor-based sensing system, and a wireless communication system. Examples of these systems are discussed in detail below. A receiving well location (e.g., a surface or subsea receiver station) can have a sensing system for receiving the wireless signals from the downhole system, an energy harvesting system, a power management and storing system, and a wireless communication system for relaying the received data to a remote location. The remote location can be another downhole tool, a surface or subsea location, a cellular tower, satellite, laboratory, etc. The remote location can comprise a secure server or Supervisory Control And Data Acquisition (SCADA) system, discussed further below.

The subject matter described in this disclosure can be implemented in particular ways, so as to realize one or more of the advantages discussed herein. One such advantage is to facilitate communication between a downhole tool and a surface station. Other advantages are facilitating communication between downhole tools. Various embodiments are different from pressure pulse systems, which are mainly used in active drilling applications, where the fluid pumped down in the tubing (drill string) is in fluid communication with the annulus as the fluid continuously circulates back to the surface via the annulus. Pressure pulse systems typically encode signals into the same fluid from which the signals are received. That fluid presents a relatively noisy signal environment because of its function, composition, and flow characteristics. For example, the fluid carrying the signal flows both down (typically within the drill string) and up (typically outside the drill string in the "annulus"). In contrast, the present solution is particularly effective in non-drilling applications. Signals can still be transmitted using flowing fluid, but they can be generated differently, they can exist at different frequencies, and they can at times bypass signal impediments. For example, the present disclosure describes sending wireless signals into a static (or relatively non-flowing) annulus section of the well, separated from the flowing fluid by the tubing and the production packer, by compressing/expanding the tubing from long waved perturbation signals. Thus, in some embodiments, the described transmission medium changes from flowing fluid to solid (tube) to static fluid. In some embodiments, perturbation signals are a change in the flow and are different from acoustic waves, compressional, shear, stress or surface waves. The described perturbation signaling typically occurs in a flowing well, which is not a good environment for acoustic wave transmission or sensing. Perturbations signals can result from a change in a flowing condition of transmission fluid. For example, such signals can result from or correspond to a change of any parameter of the hydraulic energy equation (e.g., flowrate times pressure change). Thus, perturbations signals may be encoded in the change of flow or change of pressure, or a combination of both.

In one example approach, a downhole tool can be installed at a downhole location in the well bore, to measure reservoir and fluid conditions. This measurement is processed and stored to local memory, and then encoded into a data record set forth by the wireless communication protocol. A data record, constituting the downhole measurements, is built up. The data record can include: a synchronization bit pattern often known as the head; a payload bit pattern; and a checksum validation bit pattern often known as the tail. Such data records can be transmitted by establishing a control protocol or sequence (e.g., control loop) for inducing perturbations into the flowing wellbore or flowline. A signal source can be established. For example, an electric load can be applied to the turbine generator which is hydraulically connected to the fluid in the well bore or flow line. Changes in the electric load or signal to the turbine generator can result in a corresponding pressure signal (e.g., in the form of a perturbation of or other signal within the hydraulic work or output). Thus, a change in hydraulic work of the downhole tool will result in small flow perturbations, which can be detected at another location by changes in hydraulic energy, herein referred to as "perturbations."

Perturbation signals transmitted from a downhole tool can propagate to other well locations. For example, they can propagate to another tool that is also associated with the same fluid flow (e.g., injection flow such as water in an injector well or production flow that may contain hydrocarbons in a production well). In one example, the signals are transmitted up the production tubing. Whichever direction signals are transmitted, they can encounter impediments to their effective transmission. Such impediments can include noise zones corresponding to portions of a well that are disturbed, interrupted, or otherwise flow differently. These noise zones can be caused by downhole tools, they can result from geophysical phenomena, etc. For example, as well depth decreases, the fluid pressure also decreases, resulting in larger volume fractions of free gas in production tubing. The free gas increases effective viscosity of the fluid mixture and induces stronger dissipation of the perturbations. A significant contributor to signal loss in production tubing is noise created by bubbles and slugs in a multiphase flow. Thus, the perturbation signals for most wells with saturated gas will experience severe signal losses in the flowline where that gas is present, and accordingly, subsequent detection of these signals will in some cases not be possible. This problem can be especially acute at and above a bubble point, which can therefore act as a noise zone (and signal impediment). To evaluate the location, size, or presence of such a signal impediment, a bubble point within production tubing can be determined using a Pressure-Volume-Temperature (PVT) analysis or a Fluid Properties Estimation (FPE), for example.

In contrast to the production tubing (which can serve as the flowing channel 118 of FIG. 1), the surrounding annulus (110 in FIG. 1) in most wells is filled with a diesel or brine fluid, which is typically static and pressurized to meet the static pressure of a shut-in well. This is therefore an advantageous communication channel for small perturbation signals to propagate (e.g., to surface receiver units). A baseband signal for the perturbations can be chosen such that the half wavelength (or a multiple of the half wavelength) of each perturbation partially or fully covers the distance from a production packer (or similar structure confining the annulus volume) to the measured or expected depth of the production fluid's bubble point. This distance can comprise the effective transmission area or inducement zone between production tubing 108 and the annulus 110 (see FIG. 1), which facilitates the transmission of perturbation signals 113 across the steel wall of the production tubing 108 (which has certain elastic properties). A bubble point (and a portion of a well above a bubble point containing multi-phase flow) can correspond to a noise zone creating a signal impediment within a signal transmission path. A noise zone can comprise a portion of a transmission path that is noisy (at least to the relevant signal) because of physical characteristics such as bubbles or based on the presence of a downhole tool that is disruptive to signal transmission or flow. A noise zone is an example of a signal impediment, and a portion of a well containing bubbles/multi-phase flow is an example of such a noise zone. Noise zones (and therefore signal impediments) can also result from downhole tools. Examples of downhole tools that can disrupt a signal transmission path in well tubing (thereby creating signal impediments and noise zones) can be ESP (Electrical Submersible Pumps), PCP (Progressive Cavity Pumps), sucker rod pumps or other means of artificial lift like Gas Lift, (which creates bubbles in order to reduce the fluid density). The present disclosure provides significant advantages in signal transmission through down-hole environments by wirelessly communicating around such obstacles, which can include a downhole tool or a fluid column filled with bubbles. For example, signals transferred into an annulus can bypass a noise zone or other signal impediment. In this example, the annulus is an example of a transfer zone. Transfer zones can occur in an annulus, or in any down-hole zone having a tube with flowing fluid that is surrounded by another fluid zone having different noise levels or flow characteristics.

Figure 2:
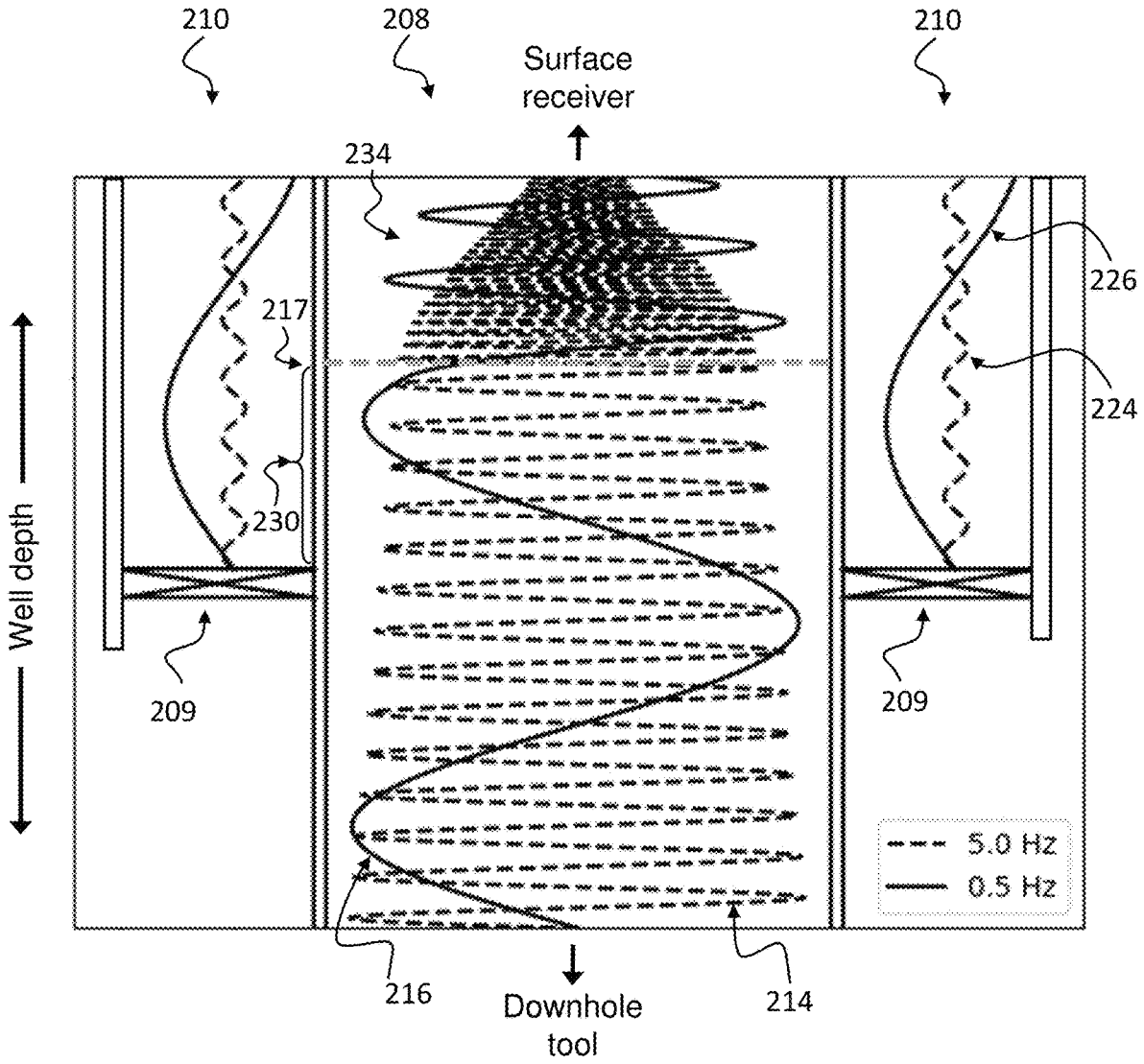
FIG. 2 illustrates examples of a pressure wave state in the flowline and induced pressure wave in the annulus, showing wavelength change and amplitude decay.

FIG. 2 provides a schematic illustration of an example transfer zone 230. Once sympathetic or induced secondary perturbation signals have been created in the annulus by the primary signals in the production tubing, these small perturbation signals 113 can propagate more readily. (E.g., they will not be obscured by the free gas bubbles emerging in the flowing well 103, but rather be transmitted through the relatively calm and static environment of the annulus 110. At the surface, the surface receiver station can have a dynamic pressure sensor connected to the annulus pressure port, where a data acquisition unit samples and collects the pressure signals from the annulus and feeds this data into a decoder in a data processing unit. The decoder can be set to receive and evaluate the chosen baseband signals set forth by the wireless communication protocol, and when the receiver synchronizes with the transmitter, for example, the transmitted data records can be successfully decoded and stored in the surface receiver's storage unit memory. The surface receiver unit can further facilitate read-out displays. The received data records can further be relayed to a remote location by wireless systems like WIFI, GSM, Iridium satellite or radio communication, or by a wired connection.

The remote connections can be a handheld device like a tablet or PC, a secure server, a SCADA system or similar.

In some embodiments, one downhole tool and one surface receiver unit can form a complete system that facilitates downhole measurements of reservoir and fluid conditions, wireless communication of said measurements from a downhole location to a surface location, where data is received and stored to a local memory. The data can further be displayed on a surface read out system and/or relayed to a remote location using other methods of data transmission.

In some embodiments, several downhole tools can be used with a surface receiver unit to establish a functional system. Such systems can facilitate downhole measurements of reservoir and fluid conditions at different locations in the wellbore, and wireless communication of said measurements from the downhole locations to the surface location, where the data can be received and stored to a local memory. The data can further be displayed on a surface read-out system and/or relayed to a remote location using other methods of data transmission.

FIG. 1 shows a schematic illustration of the arrangement of a downhole tool 100 installed in a well 103 and a surface receiver unit 101 installed at a surface 102 next to a well head 104. The arrangement further includes a reservoir 107, production tubing 108, production packer 109, annulus 110, flowline 105 and a choke valve 106 to manage the flowing pressure. The same system can be used in an injector application, for example by changing the flowing direction of the downhole tool 100. In some embodiments, the complete system can comprise two or more downhole tools 100 deployed at different depths and potentially different producing zones of the well 103. The downhole tools 100 can be installed and anchored in the well 103 by other anchoring mechanisms 111, such as a lock mandrel, gauge hanger, and/or a flow-through packer.

The downhole tool 100 can facilitate a sensing system that performs downhole measurements of the reservoir 107 or other well 103 conditions depending on the installation location, which are stored to memory for later transmission to surface 102. The downhole tool 100 can transmit measurements as a data record to a surface receiver unit 101 located nearby or on the wellhead 104.

A method of wireless communication can apply perturbations 113 of the flowing fluid between two spaced apart locations (e.g., a downhole location and a surface location, two downhole locations, etc.) to transmit information from one location to another. U.S. Pat. No. 8,169,854 B2 (Godager) discloses a system for wireless communication in a producing well where a static pulse generation device is used to generate static pressure pulses in the flowline. U.S. Ser. No. 14/377,377 A1 (Tinnen, Sortveit) discloses a method for choking the well flow for longer periods in order to induce pressure pulses. Although such static pulses have some uses, a different wireless communication signaling method disclosed herein works by inducing small perturbations 113 in the flowing fluid by applying a time varying electric load change to the turbine generator system, resulting in time varying perturbations 113 to the hydraulic energy in the flowline. These perturbations 113 can be repeated at certain frequencies and for a certain number of periods per bit transmitted, which can be coordinated with a chosen wireless communication protocol.

In some embodiments, a wireless communication protocol used is based on Binary Phase Shift Key (BPSK), where the phase angle of the baseband signal is shifted 180° to perform a binary bit shift, 0 or 1. BPSK can be mathematically expressed as:

$$\begin{cases} x(t) = A\sin(\omega t) & \text{"1"} \\ x(t) = A\sin(\omega t + \pi) = -A\sin(\omega t) & \text{"0"} \end{cases}$$

The perturbation signals 113 induced in the flowing fluid may be relatively weak compared to environmental noise. Accordingly, it may be useful to repeat each perturbation 113 signal over several periods for each bit to accumulate the signal energy in the channel. This method of wireless communication protocol is hereby referred to as Multiple Period Binary Phase Shift Key (MPBPSK) modulation, where the number of periodic repetitions of each bit may range from 2 to co (e.g., the number of repetitions has no theoretical upper limit but can be determined by practical considerations based on a point of diminishing returns). Some useful embodiments repeat an identical signal approximately 800 times, for example, adding energy through the process. By accumulating the signal energy in the channel, the wireless communication method is much more robust against unstable flow conditions associated with multiphase flow regimes typically found in production flows of oil and gas wells. A decoder can be used to sense the signal (e.g., but "listening" in a known or calculated frequency) and can accumulate energy or other information by storing it in a memory and/or adding it together, for example until a threshold is reached or a pre-determined number is achieved. For example, if it is known that a signal will be transmitted through a great distance or through a particularly noisy or otherwise difficult environment, a decoder can be programmed to detect or listen for a greater number of repetitions. Alternatively, a decoder or other apparatus may provide two-way communication. For example, a signal source may periodically pause to allow a signal recipient to report on whether it has accumulated sufficient energy or otherwise considers the transmission complete. Many implementations synchronize the transmitter and the receiver. For this purpose, highly accurate clocks (e.g., atomic clocks) can be very useful. A system can periodically or persistently attempt to synchronize using a given signal frequency (e.g., 1 hz). A number of periods or expected repetitions may be specified (e.g., 100 periods). This may be specified based on an assessment of present conditions, expected constraints, or a combination of both. A conservative approach may be used that provides many more repetitions than are ever expected to be necessary to accumulate sufficient signals for the desired communications to occur. A drawback to maximizing the repetitions may be that the time required for transmission of a given message increases significantly. Accordingly, a system or a user can attempt to balance the number of repetitions against a desired time for total transmission of a message or messages.

In some embodiments, the wireless communication protocol used is based on Binary Frequency Shift Key (BFSK), where a pair of discrete frequencies of the baseband signal is shifted between the two selected frequencies to perform a binary bit shift, 0 or 1. Each frequency can be associated with either 0 or 1 as part of the wireless communication protocol. BFSK can also be mathematically expressed. Other wireless communication protocols can also be used in this fluid perturbation context. A code can associate English letters with a binary signal. An example of this is Morse code, which uses short and long signal transmissions that are sometimes represented by dots ( . . . ) and dashes (_ _ _) This is a binary protocol because messages can be conveyed using combinations of only these two types of transmissions, even though grouped combinations of several such transmissions correspond to the 26 letters in the English alphabet. In BFSK, one discrete frequency can fill the role of a dot, and the other can fill the role of a dash. Machine language also often uses a binary approach, with 0 and 1 representing the two alternatives.

Similar as to BPSK, the perturbation 113 signals induced in the flowing fluid may be relatively weak compared to environmental noise (which may include noise from well operations). It may therefore be helpful to repeat each perturbation 113 signal over several periods for each bit to accumulate the signal energy in the channel. This method of wireless communication protocol is herein referred to as Multiple Period Binary Frequency Shift Key (MPBFSK) modulation, where the number of periodic repetitions of each bit may range, for example, from 2 to ∞ (that is, there is no upper limit but number of repetitions can be determined based on the context). MPBFSK can hold various benefits over MWD or other pressure-pulse technology. For example, mud-pulse telemetry can use a valve that closes and opens for drilling mud. Large pulses may propagate in a drill string, for example. In a typical pulse system, the pulses are relatively powerful and can be on the order of 100 psi or more, for example. Such pulses may not be feasible in many situations. Many applications contemplated by this disclosure do not use such a powerful pulse. This can avoid instability and microfractures, for example. Thus, many present applications have much more sensitive receivers or sensors that use time to their advantage. Aggregation of a signal can accomplish in an audio or other signal domain what a prolonged exposure accomplishes in an optical domain. A photographic plate that remains open to further impingement of photons may thus aggregate an optical signal. An MPBFSK approach can allow a receiver to continue sensing a signal, assuming that the same signal is being transmitted periodically, as a way to verify complete reception (or at least to improve on initial partial reception) of the repeated signal. Using a phase shift key method, a base band signal can be established, a certain message portion can be repeated frequently for a given number of bits (or for a given amount of time), and then a new message portion can be transmitted and repeated, in turn. The key can represent knowledge of the expected pattern (e.g., the expected number of repetitions, the size of the message portions, the time allocated for each portion, the frequencies of the base band signal, the frequencies of the two binary signals, etc.)

The systems and methods described here can include software and hardware that executes functions using software and hardware modules. For example, signal encoding and decoding can occur using such software and hardware modules that interact with other tools and devices via control circuitry, encoders, decoders, gearboxes, drives, etc. For example, such software and hardware modules can cause a downhole tool or electric turbine to create signals in fluid flow and another device to receive the signals at a different location in communication with the same fluid.

Perturbations and Energy

A perturbation can be created or induced within a well fluid or other well feature in various ways, and these perturbations can be associated with one or more particular frequencies. One approach to establishing a perturbation can involve changing a load in a generator within a well. Changing a load can shift hydraulic energy as a perturbation results due to conservation of energy. (That is, if a generator or other device has been drawing energy from—or imparting energy to—well fluids, turning off or otherwise changing a speed of such a device can allow a change in the energy transmitted or received (e.g., a change in frequency of a signal). This change can represent a perturbation. Perturbations often represent (or result from) relatively sudden changes. They can be created in a controlled way. For example, a turbine can be connected to a generator, which in turn can be connected to a control system which can have a micro-controller. Using the micro-controller to turn a turbine brake on or off, for example, can cause minor perturbations. Changing the speed of a turbine can also cause perturbations. Switching back and forth between two speeds can establish a framework for transmission of binary signals. For example, a higher frequency "whine" from a faster rotation can represent a 1, and a lower frequency "hum" from a slower rotation can represent a 0. Perturbations can occur within a wide range of frequencies—for example, 0.01 Hz to 100 Hz. This is different from acoustic (e.g., an ultrasonic system) that typically operates in the kilohertz range. Pressure pulse systems in drilling applications normally operate at tens of pounds per square inch (PSIs). In contrast, systems disclosed herein can operate with perturbation signals having amplitudes of less than 10 PSI, for example, 1-8 PSI or 1-3 PSI.

Induced perturbations 113 of the flow can propagate in the flowing channel as pressure waves as a result in the change of hydraulic energy. The relationship between the flowing hydraulic energy and the electric energy generated on the electric generator can be viewed and transferred from hydraulic to mechanical to electric power, $$P_{Hydr}=\Delta p\cdot Q\rightarrow P_{Mech}=T\cdot\cap\rightarrow P_{Elec}=U\cdot I$$

where P is power, p is pressure, Q is mass flow, T is torque, ω is rotational speed, U is voltage and I is current. Applying a change in $P_{Elec}$ by enabling a current (I) to flow through the electric generator, the resulting $P_{Hydr}$ will have a change in pressure (p) and/or mass flow (Q)

When a perturbation wave propagates along the flowing channel, the wave speed, $c$, and the decay rate, β, may change due to fluid hold-up, (e.g., gas hold-up), change of pressure and temperature (e.g., pressure and/or temperature gradients that may exist in the column of fluid through which the signal is intended to propagate).

FIG. 2 illustrates pressure waves in a flowline and corresponding induced pressure wave(s) in an adjacent annulus. Both typical wavelength change and amplitude decay are illustrated. This figure superimposes schematic sketches of waves on a representation of a well (e.g., and oil well) cross-section. The vertical axis generally represents physical well depth (e.g., true vertical depth or "TVD"). Portions of the annulus 210 are depicted on either side of production tubing 208, and the packer 209 also encircles the production tubing 208, thereby isolating and establishing the annulus 210. (The production tubing 208 can be an example of production tubing 108 of FIG. 1, the packer 209 can be an example of production packer 109 of FIG. 1, and the annulus 210 can be an example of the annulus 110 of FIG. 1).

A bubble point depth can be located at 217. When primary perturbation waves 214 and 216 (examples of the pressure perturbations 113 of FIG. 1) propagate through fluid in the production tubing 208, they induce secondary waves 224 and 226 in the fluid of the annulus. This induced wave effect can occur well in a transfer zone 230, which often exists or may be particularly effective between a packer 209 and a bubble point 217. Longer transfer zones generally allow for better transfer of energy and more useful correspondence between the primary waves 214 and 216, on the one hand, and induced waves 224 and 226, on the other hand. In this illustration, wave 216 has induced wave 226, and wave 214 has induced higher frequency (shorter wavelength) wave 224. This induced wave effect can occur as periodic pressure changes within the fluid or walls of the production tubing 208 expand or contract the production tubing 208, which in turn transfers energy to the packer 209 and the annulus 210, which are physically coupled to the production tubing 208. As shown, in some examples, the waves 214 and 224 can have a frequency of 5 Hertz, and the longer waves 216 and 226 can have a frequency of 0.5 Hertz.

Transmissions of energy and waves through fluids can be less effective (or at least more complicated to model) when there are multiple fluids and/or multiple phases in a given portion of a fluid column. A multi-phase environment can characterize the fluids in production tubing above a bubble point, for example, where gaseous bubbles may be mixed in with other non-gas fluids. FIG. 2 schematically illustrates how, above a bubble point, energy from perturbation waves can be absorbed and or dissipated. Thus, the waves 214 and 216 decrease in amplitude above the bubble point 217 as a damping effect 234 occurs.

In an experimental example, a bubble point was measured at approximately 1800 feet vertical depth (TVD). The gas volume fraction (the ratio of the gas volumetric flow rate to the total volumetric flow rate), or GVF was only 1% there. But at 500 feet TVD, GVF was 25%, and at well head (0 feet TVD), GVF was 50%. Thus, the environment between the bubble point became more and more gaseous toward the surface until it was half bubbles.

However, if a packer 209 is placed below the bubble point 217 such that the transfer zone 230 effectively allows transfer of energy to the annulus, this problem can be mitigated because the annulus generally has a more stable and consistent fluid environment. Thus, by transferring energy to the annulus, the waves can propagate much longer without such a damping effect. Accordingly, an annulus can be described as much "quieter" than production tubing—leading to generally better long distance signal transfer in that environment. One technique is to maximize the length of a transfer zone 230. Another technique (which can be used in combination) is to match a transfer zone length so that at least a quarter wavelength (of a given or expected energy wave) is inside the transfer zone window. This can mitigate or address potential confusion in the signal transmission, aliasing, signal loss, failure to induce, etc.

In some embodiments, a signal receiver can be associated with each of the production tubing and the annulus. Preferred embodiments are configured to take advantage of the relatively quiet annulus. Wells with pumps may include additional complications in the fluid environments for signal propagation, causing more difficulty for transmission, even through an annulus.

The equation describing the pressure fluctuations at the receiver location for the wireless communication can be described in the following way, $$\delta p(t) = A\exp(it\omega)\int_{x_s}^{0}\exp\left(-i\frac{\omega(x-x_s)}{c(x)} - \beta(x)(x-x_s)\right)dx \tag{1}$$

where A is the perturbation amplitude at the source location, $\omega$ is the frequency of the wave, t is time, $\chi$ is the depth along the well, $x_s$ depth of the source of perturbations.

Figure 3:
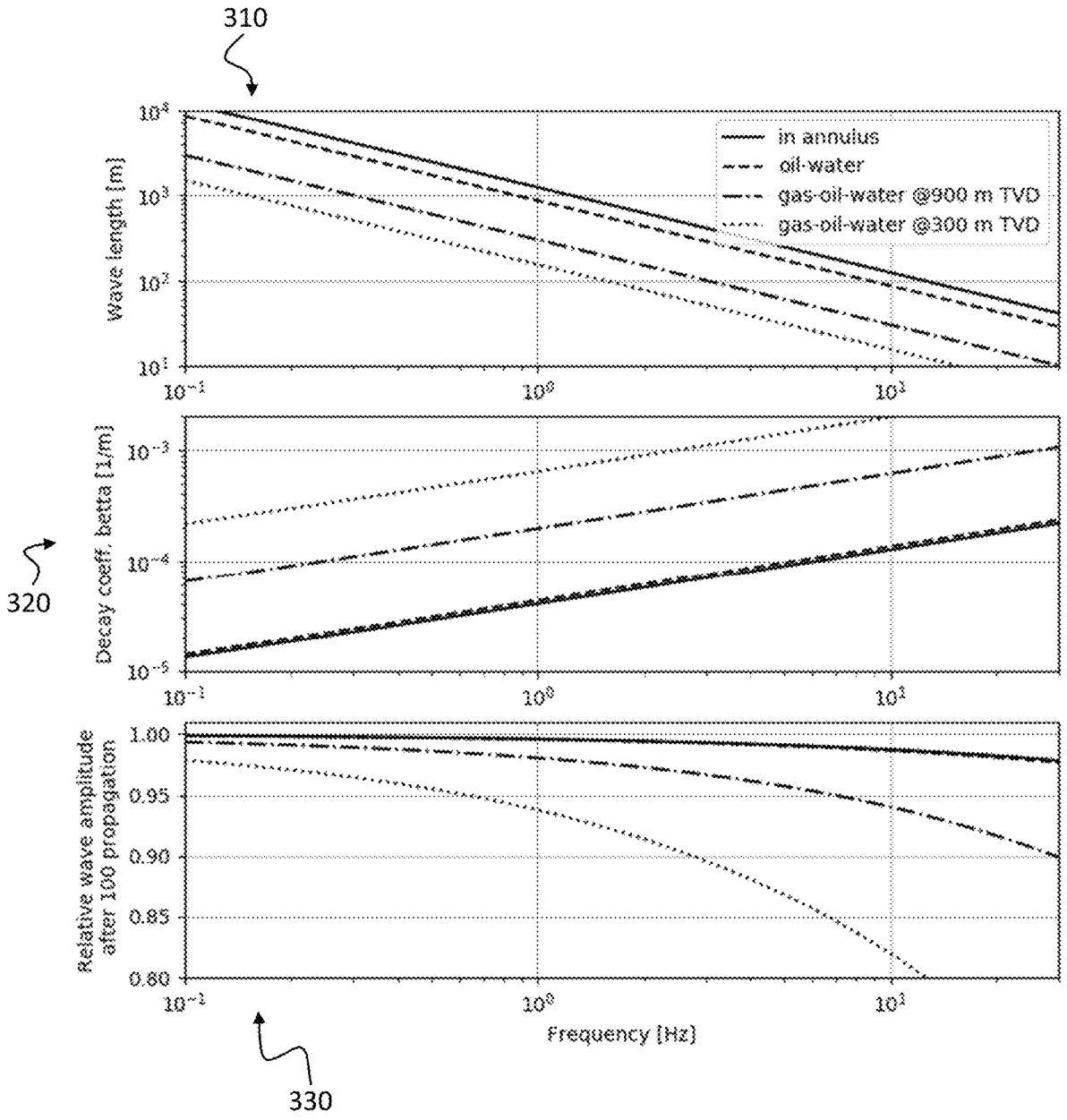
FIG. 3 illustrates example characteristics of a pressure wave, which can depend on its frequency under different flow conditions.

The decay rate is approximately proportional to the square root of frequency; therefore, the carrier frequency should in some applications be below 50 Hz, or in some applications below 5 Hz (FIG. 3).

FIG. 3 shows example characteristics of pressure waves in an oil well, which depend on frequency and other factors (e.g., flow conditions). Data is provided for the annulus, an oil-water combination, and gas-oil-water combinations at two different depths. Relative wave amplitude 330, decay coefficient beta 320, and wavelength 310 are all plotted versus frequency.

There may be a presence of several phases in the flow. For example, free gas bubbles increase the effective viscosity of the carrier fluid, and therefore, the decay rate. Hence the problems of diminished propagation, attenuation, and damping 234 in the portion of the production tubing 208 above the bubble point 217 (FIG. 2). This portion of the production tubing in this example can create a signal impediment, which in this case can also be referred to as a noise zone. After perturbations have passed the bubble point (e.g., the point 217 in FIG. 2) in a given flowline, the wave speed starts to drop faster, and the decay rate increases faster as well. Especially for wells with large gas hold-up or presence of oil-water emulsions, it can help to use smaller frequencies (e.g., ~1 Hz) for transmitting signals (see FIG. 5).

Another limitation for the transmission frequency comes from the frequency spectra of noise. Pressure fluctuations due to noise may reach level of ~1 Bar, for example, which may be larger than the typical amplitude of the perturbation used to send signals downhole (e.g., ~0.1 Bar). The carrier frequency can be advantageously selected to differ from any resonance frequencies of the well and frequencies representing noise generated by bubbles and slugs or other low frequency processes in the well. See FIG. 4 for an example noise spectrum inside the oil well.

Figure 4:
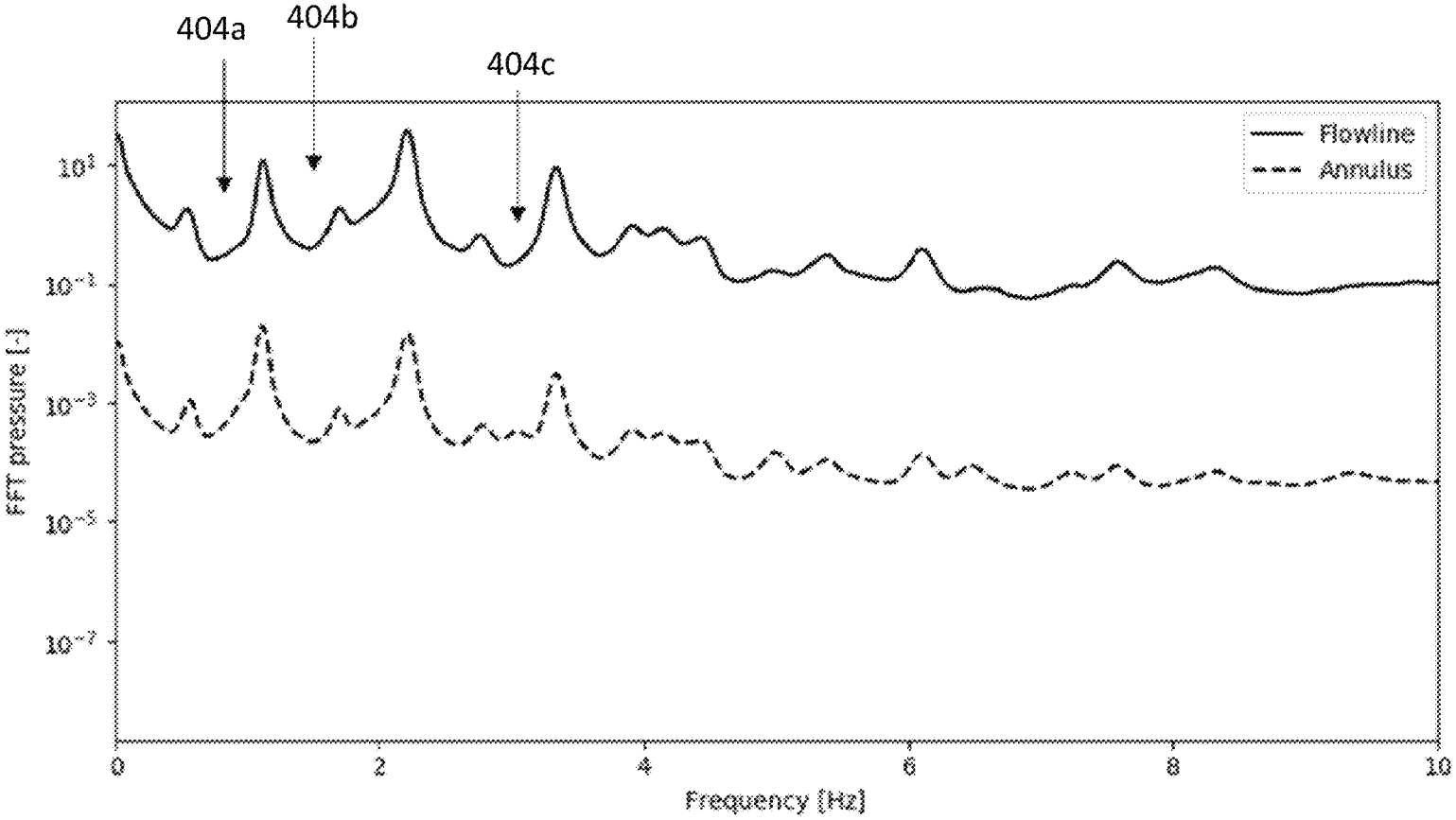
FIG. 4 shows noise spectra in an oil well and options for carrier frequency.

FIG. 4 shows that areas between or outside of noise peaks are preferred for carrier frequencies. This figure shows three examples of suitable spectral windows for the low signal carrier frequency: 404*a*, 404*b*, and 404*c*. A useful strategy for choosing carrier frequency is to analyze the noise level in the well 103 before the downhole tool 100 installation and set the carrier frequency corresponding to one of the minima in the noise spectra. Another option is to communicate the choice of carrier frequency to the tool after installation by two-way communication, such as using the options described herein under the heading "Additional Communication Options."

A method to reduce noise level (or, in some embodiments, to use signal processing to better recognize and account for noise level or better separate signal from noise) is to use long-term averaging. Over time, it is easier to determine which portions of a combined signal are due to noise and which are part of the intended signal. This effect can be more pronounced when noise has a constant, periodic, or other discernible pattern. Averaging can result in a noise level decrease (or improved ability to account for noise) proportional to the square root of time. The average value of the signal stays unchanged and converges to the actual value with increase of integration time. As a result, the signal to noise ratio for a given bit of message is proportional to the square root of time used to send one bit. Signal decoding, for example, with MPBPSK method may be achieved, for example, when a signal to noise ratio at given frequency (SNRF) is higher than 1.41. Particularly robust detection can be achieved when SNRF>2. Noise cancellation or noise compensation techniques can be used to enhance signal resolution or improve signal detection.

In a flowing channel, fluid properties such as density, uniformity, and viscosity can change with decreased depth. Appearance of gas bubbles can significantly shorten the wavelength and increases dissipation of energy per unit of well length (see FIG. 2). When dissipation is too strong in the flowing channel so that it is almost impossible to detect the perturbations 113 at surface 102, pressure measurements can nevertheless be done in the annulus 110 of the well 103. Fluid properties are typically very different outside the flowing channel. Another reason for doing measurements in the annulus 110 can be when it is impossible to find a suitable location on the flowline 105 upstream of the choke valve 106 or any other valves which may affect pressure measurements (see FIG. 1).

Annulus 110 of the well 103 is typically filled with diesel or brine, or any other fluid with relatively uniform properties and low viscosity, allowing the perturbation 113 signals to propagate without much dissipation. In general, the interaction of the fluid in the production tubing 108 and annulus 110 and surrounding casing can be rather complex due to differences in mechanical properties of the materials. Waves with the same frequency may have a different wavelength in each of the flowline 105, production tubing 108 and annulus 110 (see FIG. 1). The problem can be simplified by taking into consideration the following: a) a casing (surrounding the annulus 110) can be assumed to be a rigid material; and b) the flowing channel in the production tubing 108 is the main source of the perturbations 113, (e.g., the perturbations 113 inside the annulus 110 have negligible effect on the flowing channel in the production tubing 108).

With the assumption of rigid casing, and neglecting for simplicity the variation of the pressure along the flowing channel in the production tubing 108, the change of the pressure inside the annulus 110 ($\delta_{p_a}$) is related to the pressure inside the tubular part of the production tubing 108 ($\delta_{p_i}$) in the following way:

$$\delta p_a = C_{io}\delta p_i = \frac{\dfrac{2r_i^2}{r_o^2 - r_i^2}}{\left[\dfrac{r_c^2 - r_o^2}{2r_o^2}\dfrac{E}{K} + \dfrac{r_o^2 + r_i^2}{r_o^2 - r_i^2} - \nu\right]}\delta p_i \tag{2}$$

Where $r_i$ is the inner radius of tubular, $r_o$ is the outer radius of tubular, $r_c$ is the inner diameter of the casing, E, $\nu$ are the Young's modulus and Poisson's ratio of the tubular material, and K is the bulk modulus of the fluid inside the annulus.

The wavelength in the annulus 110 is typically larger than the wavelength in the flowing channel 118, especially at depths beyond the depth of the bubble point 117 (see FIG. 2). In certain circumstances, the most efficient energy transfer from the flowing channel 118 to the annulus 110 can happen when the carrier frequency is low, and the wavelength is large. In this case it can be assumed that the whole annulus 110 is compressed by the pressure perturbations 113 in the flowing channel 118 (also referred to as a flowline). An efficient situation (e.g., in certain circumstances, the most efficient transfer of energy) happens when half of the wave length in the flowing channel 118 is equal to or larger than the distance between production packer 109 and the bubble point 117. After the bubble point 117, the wavelength in the flowing channel 118 becomes significantly shorter and, under certain circumstances, it can be assumed that such pressure perturbations 113 have zero (or at least very minimal) cumulative effect on the pressure in the annulus 110.

The cumulative force on the annulus from the flowing channel can thus under the described assumptions be mathematically expressed as the integral of the pressure on the outside of tube along the whole length of the annulus ($h_{an}$):

$$F(t) = (2\pi r_o + 2\pi r_c)C_{io}\int_{h_{an}}^{0}\delta p_i(t, h)dh \tag{3}$$

where $$\delta p_i(t, h) = A\exp(it\omega)\int_{h_s}^{h}\exp\left(-i\frac{\omega(x - h_s)}{c(x)} - \beta(x)(x - h_s)\right)dx$$

is the pressure perturbation at the given depth of the well.

The equation above can be written in the following form:

$$F(t)=(2\pi r_o+2\pi r_c)h_{an}C_aC_{io}A\exp(it\omega+\phi) \tag{4}$$

where the effective area coefficient is as follows:

$$C_a = \mathrm{Re}\left[\frac{1}{h_{an}}\int_{h_{an}}^{0}\left[\int_{h_s}^{h}\exp\left(-i\frac{\omega(x - h_s)}{c(x)} - \beta(x)(x - h_s)\right)dx\right]dh\right] \tag{5}$$

Figure 5:
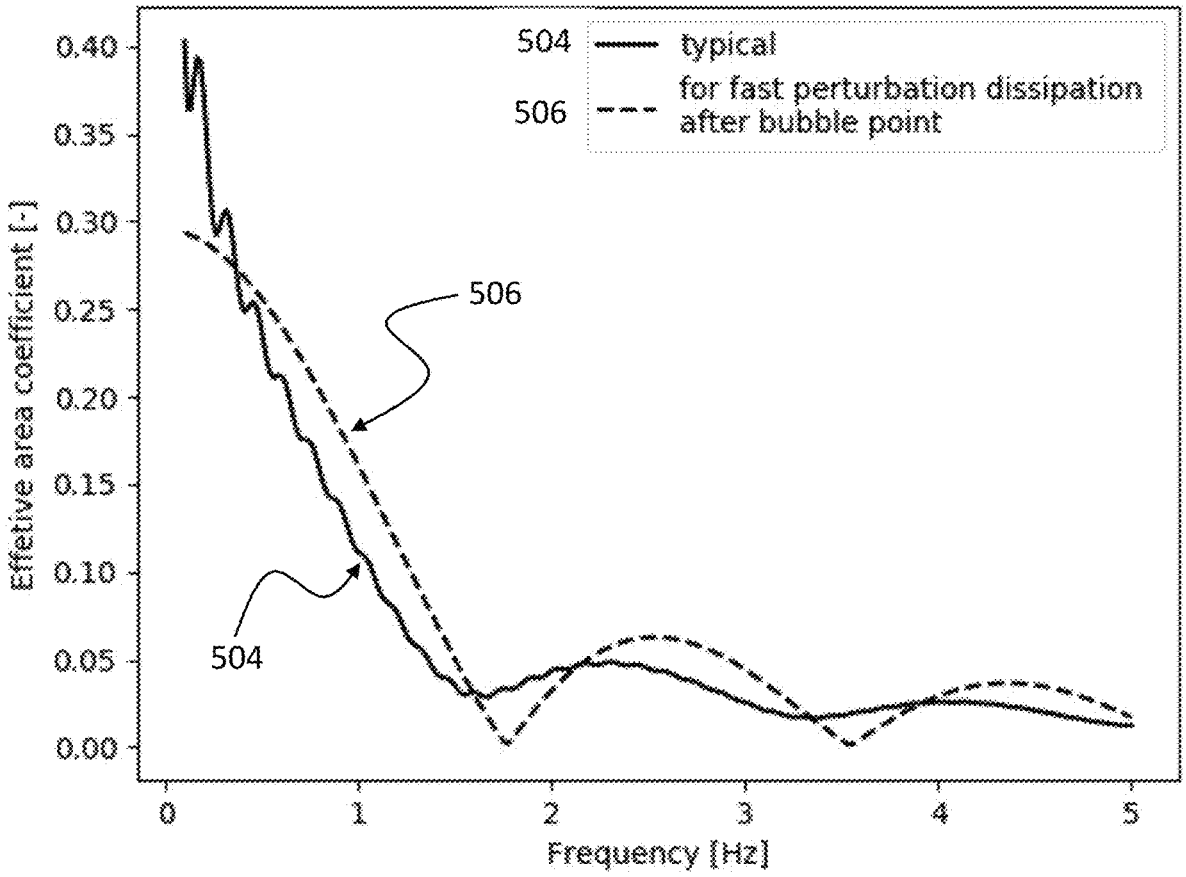
FIG. 5 shows a plot of effective area coefficient describing force acting from a flowline on an annulus.

FIG. 5 illustrates a plot of typical values for effective area coefficient, for different frequencies. This coefficient can help describe force acting from the flowline on the annulus to create induced waves at a transfer zone 230 (see FIG. 2). Since higher values are more effective, this plot suggests that an effective (e.g., the most effective) transfer of the signal happens at the frequencies below 1 Hz, with the amplitude of pressure perturbations in the annulus approximately $c_aC_{io}$ times the pressure perturbations generated downhole. The solid line 504 is an example (e.g, a typical) variation of effective area coefficient with frequency. The dashed line 506 shows another example of behavior above the bubble point—where the pressure perturbations decay quickly after passing the bubble point.

In some embodiments, the downhole tool 100 can have an onboard measurement system comprising one or more sensors (X, Y . . . see FIG. 6) connected to a data gathering system. The data can be measured through a fixed measurement cycle at periodic time intervals. The data can also or alternatively be measured on an interrogated basis (e.g., the measurement cycle can start as a response to an external command).

Figure 6:
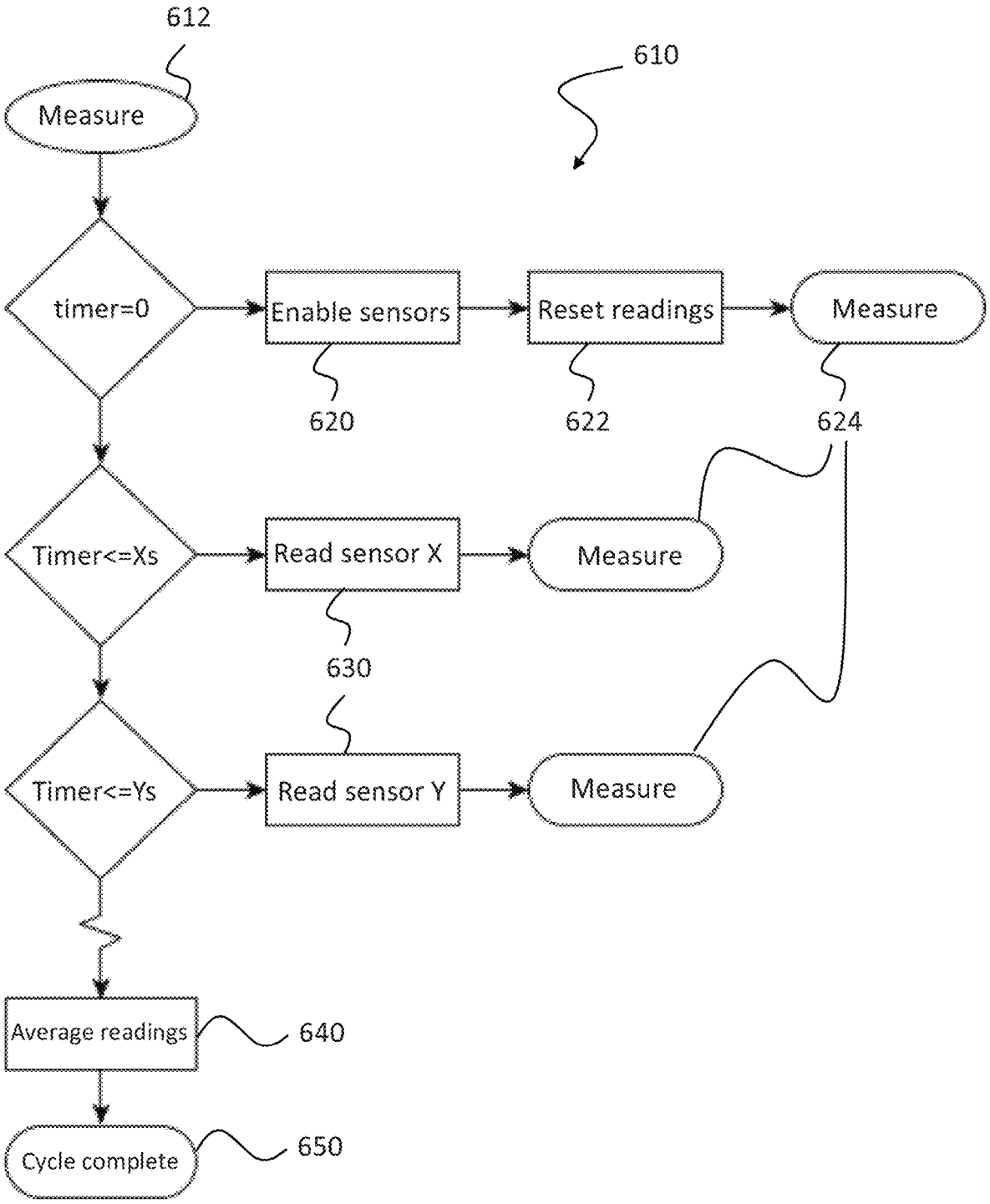
FIG. 6 is a flowchart illustrating a downhole tool measurement cycle.

FIG. 6 shows an example downhole tool measurement cycle with a flowchart 610. A measurement cycle may be automatically or manually initiated as shown at 612. At an initial time (timer=0), sensors are initially enabled 620, readings are reset 622, and sensors measure 624. At a time that is less than or equal to a given time for an X sensor (timer<=$X_s$), sensor X provides a value or is measured 624. At a time that is less than or equal to a given time for a Y sensor (timer<=$Y_s$), sensor Y provides a value or is measured 624. Additional or fewer sensors can be used in the cycle. In this illustration, they are sequentially read 630, and readings are averaged 640 to complete the cycle 650. Alternative cycles can read sensors in parallel or series, or the sequence can change dynamically or periodically, or on demand or based on other factors or controls. In some embodiments, sensors can provide continuous data without requiring a reset, periodic enablement, or averaging. In some embodiments, missing or less granular sensor data can be estimated, interpolated or extrapolated from existing sensor or other data.

Scaling

After a measurement cycle is completed, a full or partial resolution copy of the measurements can be stored to onboard flash memory, for example. In some embodiments, the sensor measurement values can be scaled down (e.g., compressed, sampled, averaged, etc.) to facilitate efficiency, conserve resources (including relevant bandwidth, etc.) and enable transmission of less data. A measurement value can be scaled by reducing the range from a minimum to a maximum value, for example, and normalized to fit a given number of bits. The range scaling can be expressed as follows:

$$X = \frac{2^{Bits} * (\text{Value} - \text{Min})}{\text{Max} - \text{Min}}$$

A measurement value can further be scaled down by reducing the resolution by removing a number of decimals and rounding off the values.

Measurement values can then be implemented in the data record scheduled for wireless transmission. The data record structure can comprise three major parts. Synchronization bits, payload bits and checksum bits. In some embodiments, the data record structure comprises two major parts, payload bits and checksum bits. The payload bits can comprise the substantive message or data to be transmitted, while the synchronization and checksum bits can help enable proper operation of the system. In noisier environments or for longer transmissions, these enabling portions can be more important and a system or transmission protocol can devote more relevant bandwidth (e.g., time, or other resources) to them accordingly.

Synchronization Bits

In some embodiments, synchronization bits are configurable as a number of alternating bits used to prepare the receiver for the incoming data record. In some embodiments, preparation of the receiver can be somewhat analogous to tuning a radio receiver to the frequency of an expected transmission. The alternating bits can mean a phase shift for each bit. This can be useful to overcome two fundamental problems with BPSK modulation, phase ambiguity and bit-shift detection. These two fundamental problems increase in difficulty with the increasing number of bit periods. In some embodiments, additional or more frequent synchronization bits can be inserted to periodically re-set a receiver and address such problems.

The phase ambiguity problem is due to the carrier synchronization algorithm. This method may only be valid when the phase angle shifts 180° for a bit shift, for example.

$$-\frac{\pi}{2} < \theta < \frac{\pi}{2}$$

If this is applied between two identical bits (e.g., a continuous sine wave) it may synchronize between two bits as this looks like a valid carrier. The synchronization algorithm can therefore benefit from using actual bit-shifts, where the carrier transitions from one phase to another, to improve synchronization and mitigate or avoid this problem. Such bit-shifts can be represented by a repeating step function.

The payload bits can include measurement data and other substantive information for transmission—for example, scientific measurements regarding geologic properties of a well or surrounding strata, data regarding pressures, flow rates, structural well integrity, etc. The payload bit structure is configurable for different applications, where different sensor values or other information can be structured in an allocated bit string to make up the payload data.

Checksum Bits

The checksum bits can serve as a "Cyclic Redundancy Check" (CRC) code to validate a data record against bit errors. When a block of payload data is structured, the value of all bits in the payload bit string can be converted into a number value, by bit-to-number conversion, and then this number value can be divided by a value (e.g., a known polynomial value). The remainder of the polynomial division can then be converted to a bit value and attached to the data record as the checksum bits. When the complete data record is retrieved on the receiver side, the checksum calculation can be repeated, and the remainder of the polynomial division compared to the transmitted checksum value. If these values do not match, the data record can be discarded, and if they match the data record can be accepted. In some embodiments, discarded data records can be subjected to corrective actions, where the checksum value is used to calculate the payload number value, which is then converted into the payload bit string. This corrective action can in some cases generate data records with corrupt data, or measurement values with lower confidence (and the integrity of the decoded data treated accordingly). In some embodiments, the CRC code used for the wireless communication is the CRC-16-CCITT, a 16-bit checksum protocol. In some embodiments, the CRC code used for the wireless communication is the CRC-32, a 32-bit checksum protocol.

Figure 7:
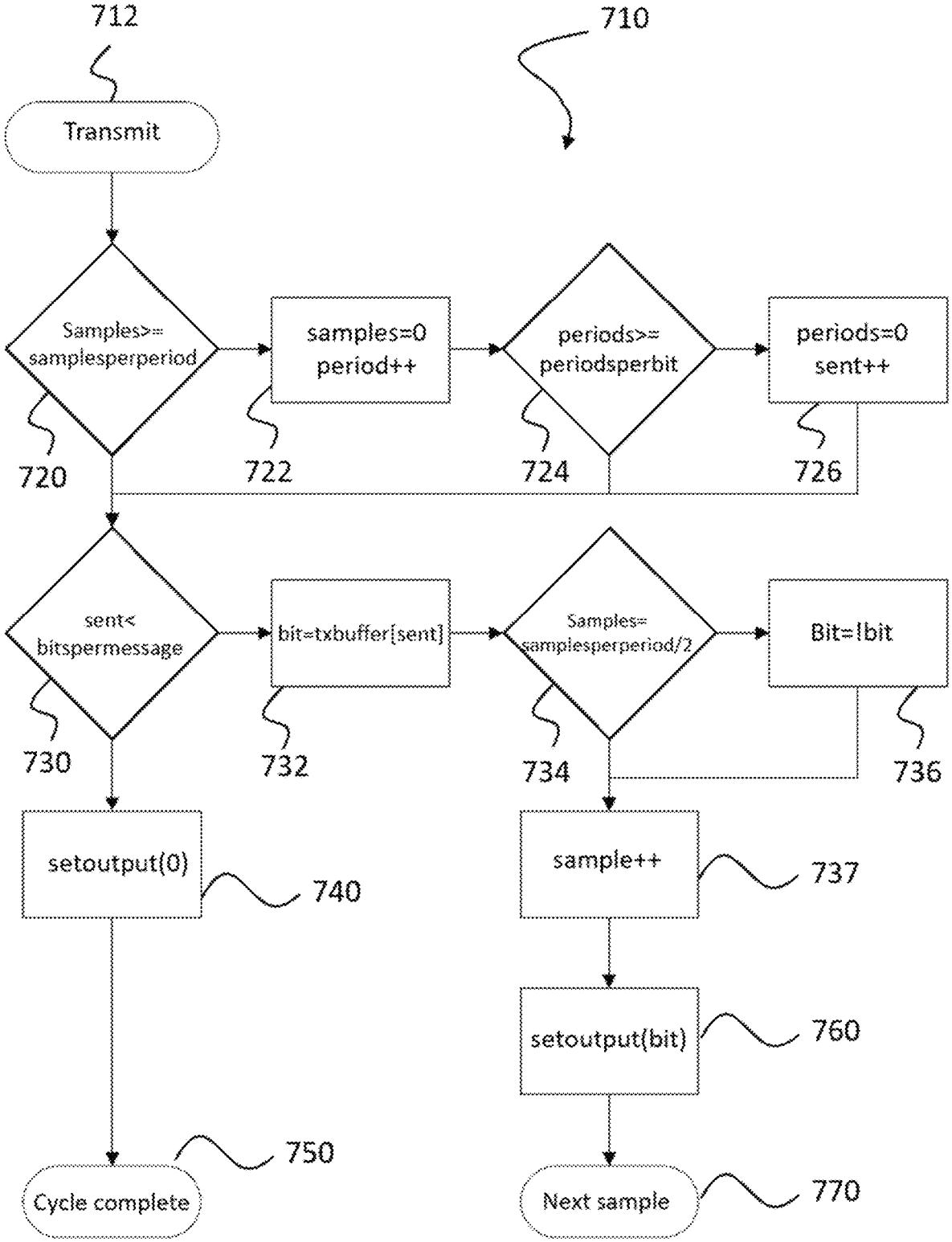
FIG. 7 is a state chart illustrating how a transmitting control loop can function.

FIG. 7 shows a state chart 710 describing an example of how the transmitting control loop can function. When the data record is complete (e.g., using the steps described generally in the description associated with FIG. 6), the data record bit string can then be packed into a transmitting buffer and the transmitting control loop can then iterate through each bit. For example, as described by the state chart 710 in FIG. 7, a transmit signal 712 can begin the cycle. If a samples variable is less than samples per period 720, a sent variable will be checked to see if more bits should be sent 730, and proceed to load the first bit from the txbuffer 732. The samples variable will then be checked to see if is it halfway in the period 734 and then phase modulate the output by inverting the bit 736 when it is. Then the sample variable (sample++) 737 will be incremented and the setoutput is then set low or high 760 depending on the bit value (0 or 1) and the cycle is repeated for the next sample 770. This will continue until the samples variable equals samples per period 720, indicating that a full period has been transmitted. Samples will then be reset and the periods variable (periods++) incremented 722 and then the periods variable will be checked to see if more periods should be sent 724, otherwise periods variable is reset and the sent variable (sent++) 726 is incremented in order to advance to the next bit. The cycle is repeated until the (sent=bits per message) 730 and then the setoutput is disabled 740 and the cycle is complete 750. In some embodiments, the transmitting control loop will operate on a micro controller. The transmitting control loop can govern the load controller, which in turn can control the loading of the generator.

Figure 8:
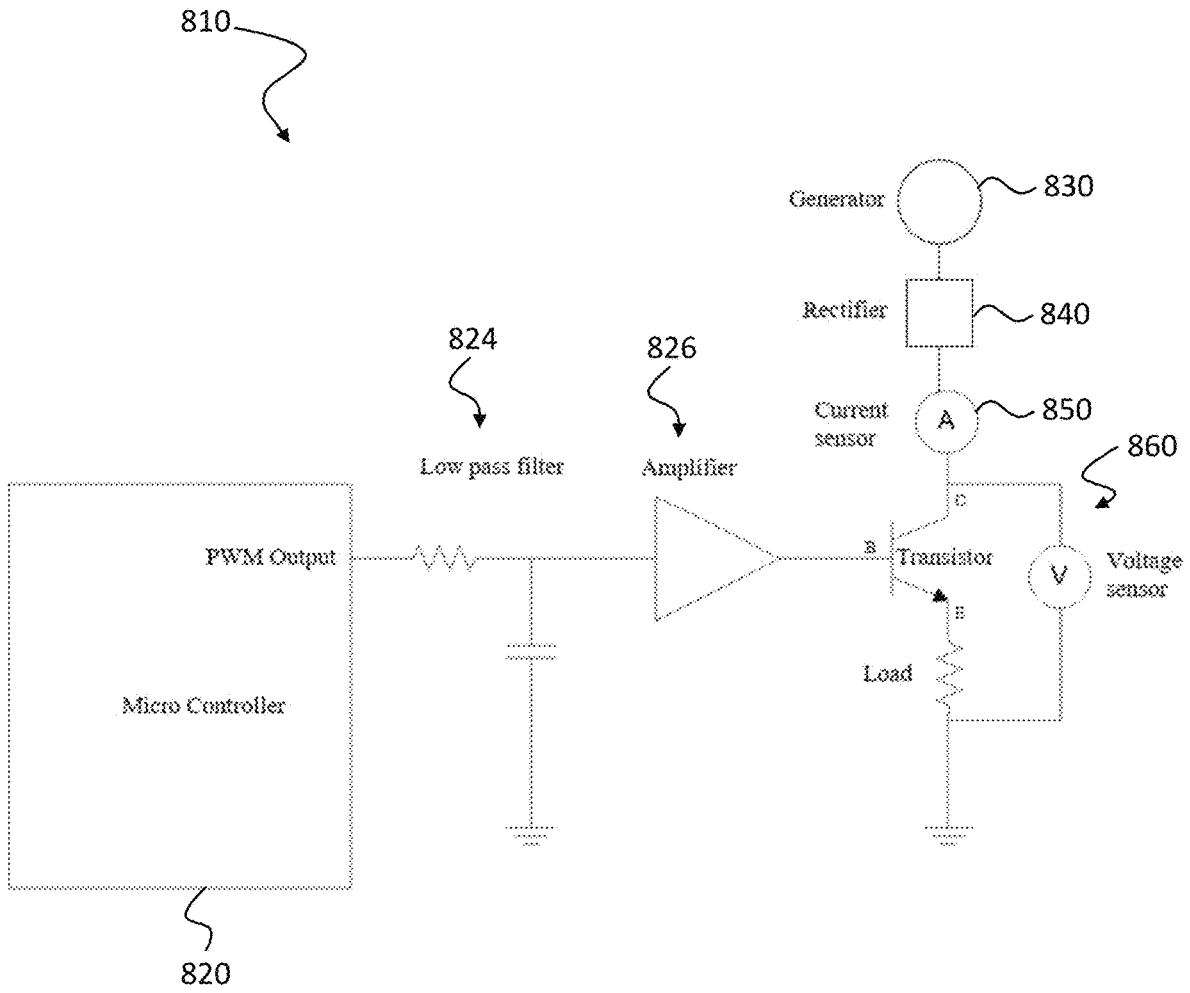
FIG. 8 is a circuit diagram of an example load controller.

FIG. 8 illustrates an example circuit diagram for a load controller. In some embodiments, the load controller circuit 810 comprises a micro controller 820, low pass filter 824, and amplifier 826. These can be connected to a portion of the circuit 860 that includes a transistor, voltage sensor and the load, configured as shown. Also connected can be a generator 830, a rectifier 840, and a current sensor 850, configured as shown. Thus, rectified output from the generator 830 can be provided to the circuit. The load is controlled by a Pulse Width Modulation (PWM) output signal from the micro controller 820 which is lowpass filtered to output a variable DC voltage. The variable DC output voltage is amplified before it is fed into the load switch control input, which in this embodiment is a transistor base. The DC voltage difference between the base and emitter on a transistor governs the resistance between the collector and the emitter, which in turn can govern the amount of load to which the generator is subjected. The load switch may additionally or alternatively be an array of transistors connected in parallel to distribute the load. The load controller circuit disclosed can enable full control of the amplitude and duration of the generator load from the micro controller, to enable several different load modulation schemes.

In some embodiments, the generator load is continuously measured, and a load controller loop controls the level of load to be applied to the generator set forth by threshold values. In some embodiments this threshold value can be the generator voltage minimum value. In some embodiments, the generator voltage minimum value can be related to the battery supply voltage. The generator voltage minimum value can be related to the minimum system supply voltage. The threshold value can be determined or informed by the transmission effect. The transmission effect can be monitored by measuring the generator voltage and the load current and multiplying those measurements. If the measurement scale and units are Voltage for the generator voltage and Ampere for the load current, the transmission effect can be expressed in Watts. The transmission effect threshold value can relate to a maximum value to protect the load system and the electric generator from electrical surges, from receiving or generating too much current, and/or from overheating.

Wireless signals can be transmitted to another location (e.g., by methods described under the heading "Perturbations and Energy.")

Figure 9:
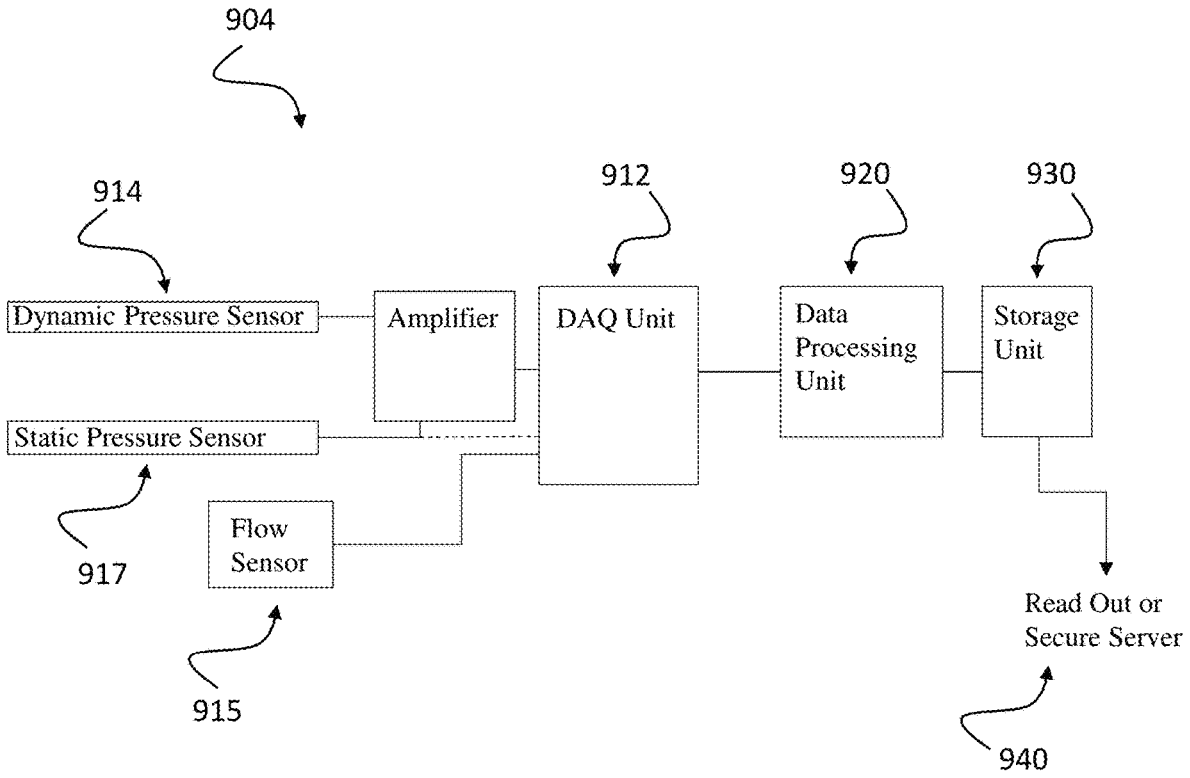
FIG. 9 is a diagram of an example receiver system.

FIG. 9 illustrates an example receiver system. Receivers can have sensors, which can comprise pressure sensors and/or flow sensors. These can determine flow rate and pressure, for example. Pressure sensors can have a transducer that is physically exposed to a fluid to determine the pressure. A transducer with, for example, some kind of membrane or other surface exposed to fluid in an annulus or other well component can help determine the fluid pressure through measurements of force and/or displacement against a bias. The membrane, surface, spring, etc. may in turn connect with an electrical component and convert analog to digital signals related to pressure. Flow sensors and pressure sensors can work together to help capture relevant signals. For example, a flow sensor can have the same frequency and pace as a pressure sensor.

Flow meter types include Coriolis flow meters (measuring a twisting effect of oscillating tubes through which fluid is flowing), ultrasonic flow meters (which use a linear shift in the frequency as the speed of the fluid increases), thermal flow meters (measuring speed at which injected heat dissipates), turbine flow meters (measuring rotational speed of a mechanical rotor with known dimensions), and differential pressure flow meters (using a pipe construction and Bernoulli's equation). A flow sensor can comprise a constrained area having a known cross section for the sensor to observe. A flow sensor can also or alternatively sense distinctive portions within a flowing fluid and assume that the displacement of a distinctive portion over time can allow calculation to determine the generalized flow rate, optically or otherwise.

Turning to FIG. 9, at the receiving location, a receiver system can comprise a sensor system 904, a Data Acquisition (DAQ) system 912, a data processing unit 920 (e.g., containing the demodulator), and/or a storage unit 930 to store the received data records. The sensor system can be a sensitive dynamic pressure sensor 914 in communication with the flowline, which can comprise or fill the role of the flowline receiving sensor 114 (see FIG. 1). The sensor system can be in communication with a coaxially spaced fluid volume to the flowline sensor 915, which can comprise or fill the role of the annulus receiving sensor 115 (see FIG. 1). Alternatively or additionally, the sensor system can be a static pressure sensor 917. Alternatively or additionally, the sensor system can comprise a combination of pressure sensor types and locations. The sensor system 904 can have (e.g., the flow sensor 915 can be) a flow rate-based sensor in communication with the flowline, which can comprise or fill the role of the flowline flow sensor 116 (see FIG. 1). The DAQ unit 912 can be connected directly with one or several sensors, or in a particular embodiment be connected through an amplifier circuit. The DAQ unit 912 can output a stream of sensor measurements at a configurable sampling rate, which can be directed into the data processing unit containing the demodulator. The data processing unit 920 can contain a series of filters to prepare the output stream for the demodulator. In some embodiments, the data output stream can have a data rate of 10 kHz and is directed through a three-stage decimation filter, down sampling the signal to 2 kHz, 400 Hz and finally ending up with a fixed 100 Hz output. This process can also include low-pass filtering of the signal with a cut-off frequency of 10 Hz and can be realized using phase-correct Finite Input Response (FIR) filters. The demodulator can output the decoded bits and data records to a storage unit 930, where the data can be forwarded or accessed by a read-out unit or a secure server at a remote location 940. An example demodulator is further described below with reference to FIG. 10.

Figure 10:
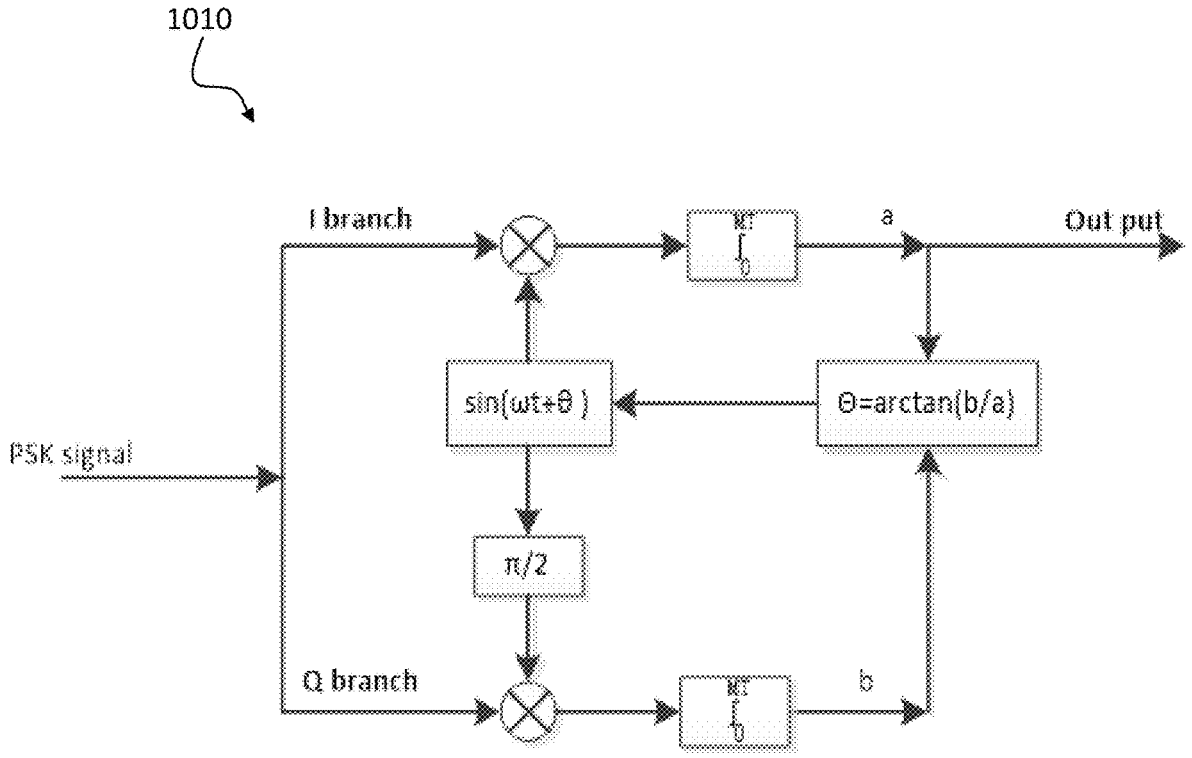
FIG. 10 shows example I and Q branches for a signal, forming a phase locked loop.

FIG. 10 illustrates a demodulator 1010, which can comprise a phase locked loop with I and Q branches. For a particular implementation of decoding MPBPSK wireless signals at the receiving location, the output stream can be divided in I-Q branches, forming a phase locked loop.

The local I-branch carrier is:

$$y_I(t)=\sin(\omega t)$$

The output of the I-branch (a) is:

$$a(t=T)=\int_0^T \sin(\omega t+\theta)\sin(\omega t)dt=\frac{AT}{2}\cos(\theta)$$

The local Q-branch carrier is:

$$y_Q(t)=\cos(\omega t)$$

The output of the Q-branch (b) is:

$$b(t=T)=\int_0^T A\sin(\omega t+\theta)\cos(\omega t)dt=\frac{AT}{2}\sin(\theta)$$

The phase angle θ can then be estimated using the tangent value:

$$\theta = \arctan\left(\frac{b}{a}\right)$$

which can be used to adjust the local carriers and synchronize to the input signal:

$$y_I(t)=\sin(\omega t+\theta)$$

$$y_Q(t)=\cos(\omega t+\theta)$$

The demodulated input can then be derived directly from the I-branch:

$$\begin{cases} x(t) = A\sin(\omega t) & \text{"1"} \\ x(t) = A\sin(\omega t+\pi) = -A\sin(\omega t) & \text{"0"} \end{cases}$$

The wireless communication protocol can use multiple periods per bit to accumulate more energy into the channel. Thus, the decoder system can use a bit-shift detection capability for the receiver to predict when the individual bits start and stops during a multiple repetitions of a bit. If any problems arise in this prediction process, they may be addressed with transmitted data records that include a (e.g., predetermined) synchronization bit pattern in the beginning of each data record bit string. The synchronization bits can be several alternating bits, which enable the decoder to "lock on" and synchronize to the carrier signal. The synchronization bit pattern is described further under the heading "Synchronization Bits" herein. Synchronization bits can be included at other or additional positions in a bit string. More opportunities to "lock on" can be created. Long distance transmissions and/or noisy environments may warrant this approach, even if it does tend to reduce availability of bandwidth or other resources (e.g., amount of a total transmission packet time or space available for other material such as a payload signal).

The phase angle between the I-Q branches can be used for synchronizing to the transmitter carrier while a sliding window system can be used to synchronize to the bit-shifts. The sliding window system (See FIG. 11) refers to tracking the I-branch with three different time windows (previous, current and next) and comparing which window has the strongest signal to determine whether the receiver should move forward or backwards in time to synchronize with the carrier signal.

Figure 11:
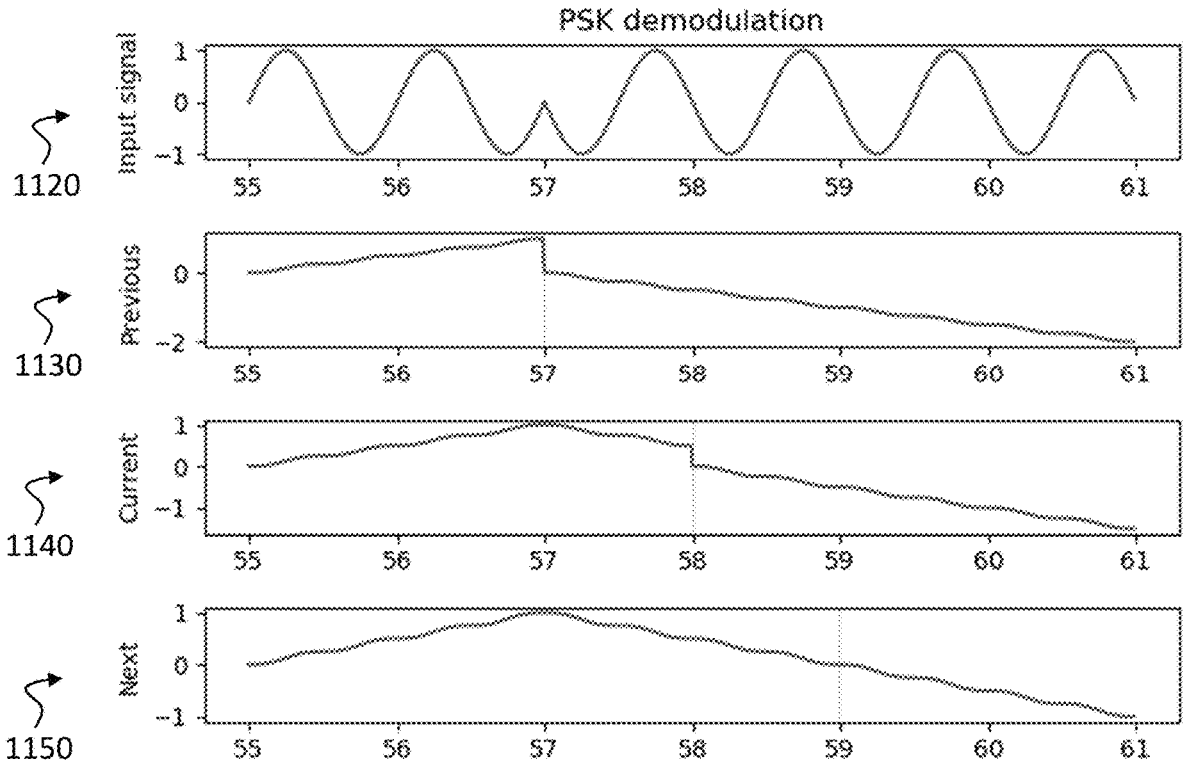
FIG. 11 shows an example view of a sliding window system.

FIG. 11 shows an example view of the sliding window system for phase key (PSK) demodulation, with an input signal 1120, a previous window 1130, a current window 1140, and a next window 1150. The windows 1130, 1140, and 1150 provide a plot of energy versus time. Thus, between times 55 and 57 of the previous window 1130, a demodulator (or decoder) is increasing in energy, and after a discontinuity at time 57, energy decreases. This example shows that the "previous" window has a discontinuity of the highest magnitude, thus the receiver will start the next integral a configurable number of periods earlier. If the discontinuity of the greatest magnitude occurred in the current window 1140, the receiver would start the next integral as currently scheduled. And similarly if the discontinuity of the greatest magnitude occurred in the next window 1150, the receiver would start the next integral a configurable number of periods later. This method relies on the I-branch which will trend up in positive value when the input signal is in phase, and trend down in negative value when the phase is shifted 180°. Upon a phase shift, the absolute value of the different windows (integrals) can be used to find the strongest magnitude to estimate the position of the phase-shift.

Figure 12:
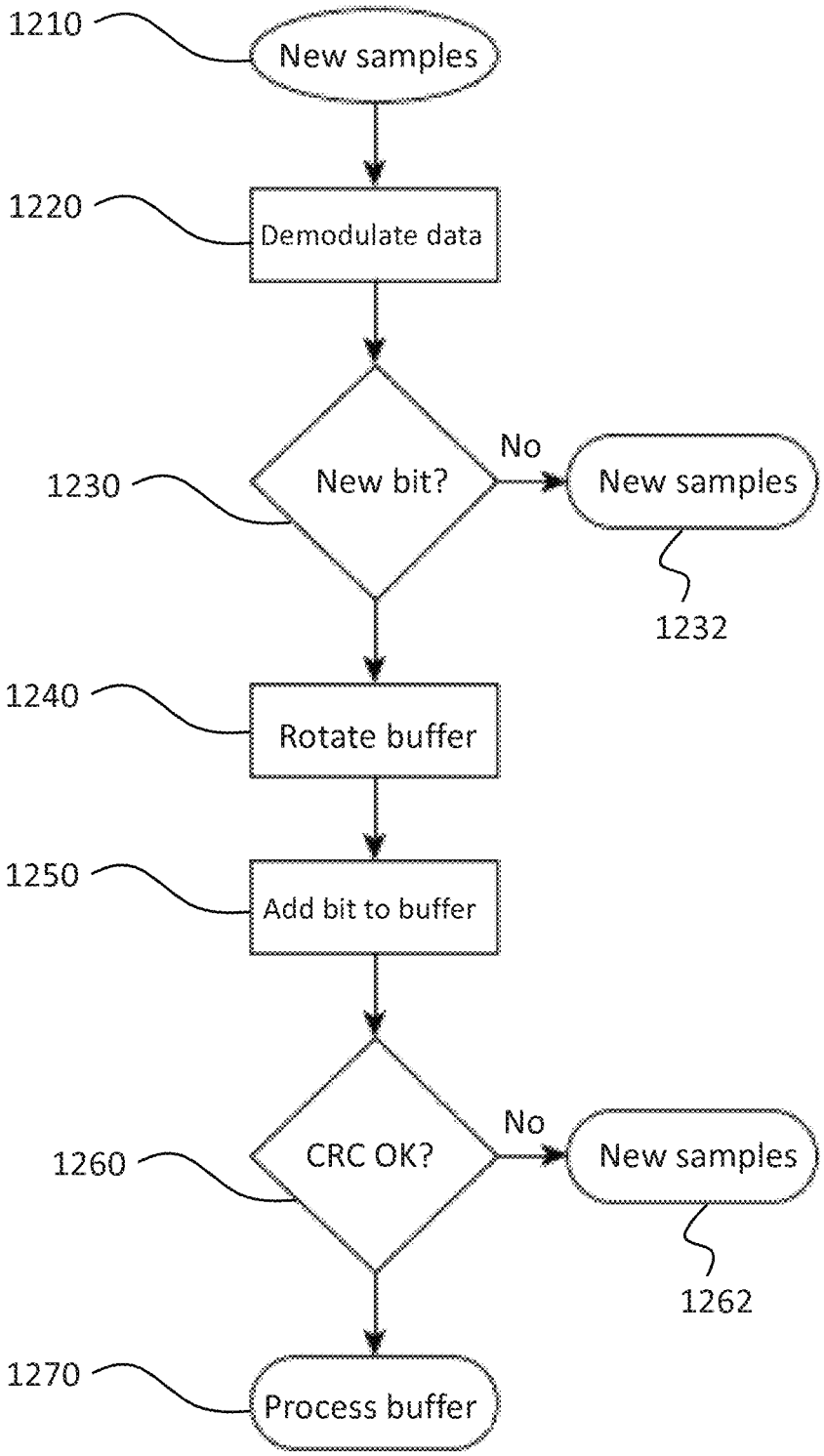
FIG. 12 is a flowchart illustrating an example data demodulation and checksum validation process.

FIG. 12 shows a flowchart illustrating how a demodulator can work—for example, a demodulator in a data processing unit 920 (see FIG. 9). When new samples 1210 are received or available, the data can be automatically demodulated 1220. If a new bit is detected 1230, the demodulator populates a receiver buffer continuously and may start looking for a valid checksum after receiving the number of bits expected from a data record. If the checksum does not find a match it can continue to rotate the buffer and append the next bit until a match is acquired. Thus, a buffer can be rotated 1240 when new bits are present and bits can be added to the buffer 1250. If a cyclic redundancy check (CRC) is ok 1260, the buffer can be processed 1270. When no new bits are found, the demodulator can begin a new cycle with new samples 1232. Similarly, if a CRC is not ok, new samples can be processed (or the same sample can be reprocessed) 1262.

When a data record is accepted by the checksum verification code described herein under the heading "Checksum Bits," a receiver can start to decode the contents of the receiver buffer. It can then process the buffer 1270 by splitting up the payload part of the buffer into fields for each value according to the payload data configuration, and scaling the values back into measured values depending on the type of scaling used. This is further explained under the heading "Scaling" herein.

The individual measured values can be logged to a file in the storage unit (see FIG. 9) as raw integer-values. Alternatively or additionally, the individual measured values can be converted from raw integer-values to engineering units and then logged to a file. The logged values can have an associated timestamp and a signal strength estimation logged to the file. In some embodiments, the timestamp is UNIX time or other time determined by a system-wide or other standardized or highly accurate clock. The time stamp can be a configurable time counter. The signal strength estimation can be a relative energy accumulation estimate, where the signal energy level, in some embodiments expressed as dB, is shown for each received data record.

After reception of a data record (e.g., by a receiver system), the receiver can wait for a configurable amount of time until resuming the decoding process with the current synchronization. In some embodiments, the receiver directly resumes the decoding process for the next data record from the transmitter. The transmitter and receiver can be appropriately synchronized after a data record is received.

Figure 13:
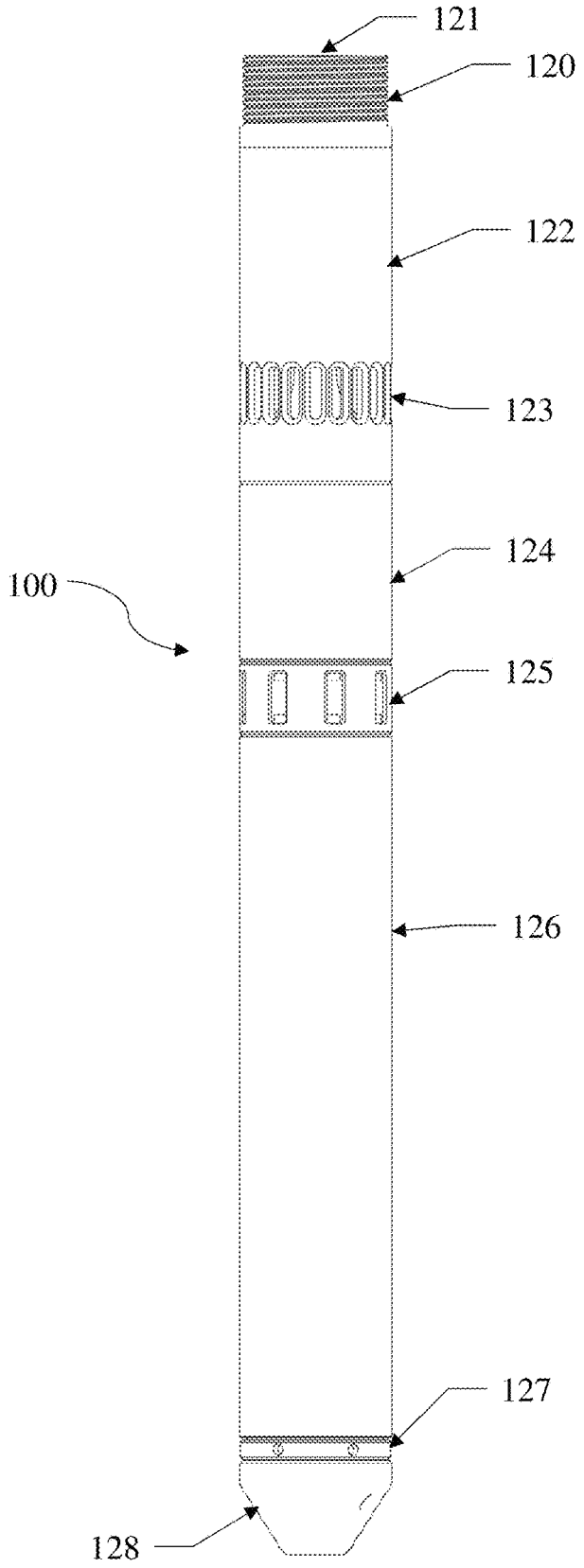
FIG. 13 is a plan view of an example downhole tool.

FIG. 13 shows an external view of an example downhole tool 100 (see FIG. 1). The downhole tool 100 will in some arrangements facilitate a x-over 120 which has a threaded connection to a downhole anchoring mechanism 111 (see FIG. 1), such as a lock mandrel, gauge hanger or a flow-through packer. The x-over 120 further facilitates the outlet flow port 121 for the fluid flowing through the downhole tool 100. The illustrated downhole tool 100 further comprises a turbine compartment 122, enclosing the turbine assembly. Inlet flow ports 123 can enable fluid commutation through the downhole tool 100. An electric generator can be connected to the turbine assembly. The generator can be enclosed in the generator compartment 124. The generator compartment 124 can be connected to the electronics compartment 126 via a bulkhead body 125. The bulkhead body 125 can facilitate pressure separation and electric connection between the generator compartment 124 and electronics compartment 126. The illustrated downhole tool 100 has a nose assembly 128, which is held in place with the swivel lock-nut 127. Opening the nose assembly 128 can help enable access to the electronic assembly housed in the electronics compartment 126. The nose assembly 128 in this example can facilitate a sealing stack to provide sealing integrity and protect the electronic assembly from harsh downhole conditions, e.g., corrosive fluids and high pressure.

Figure 14:
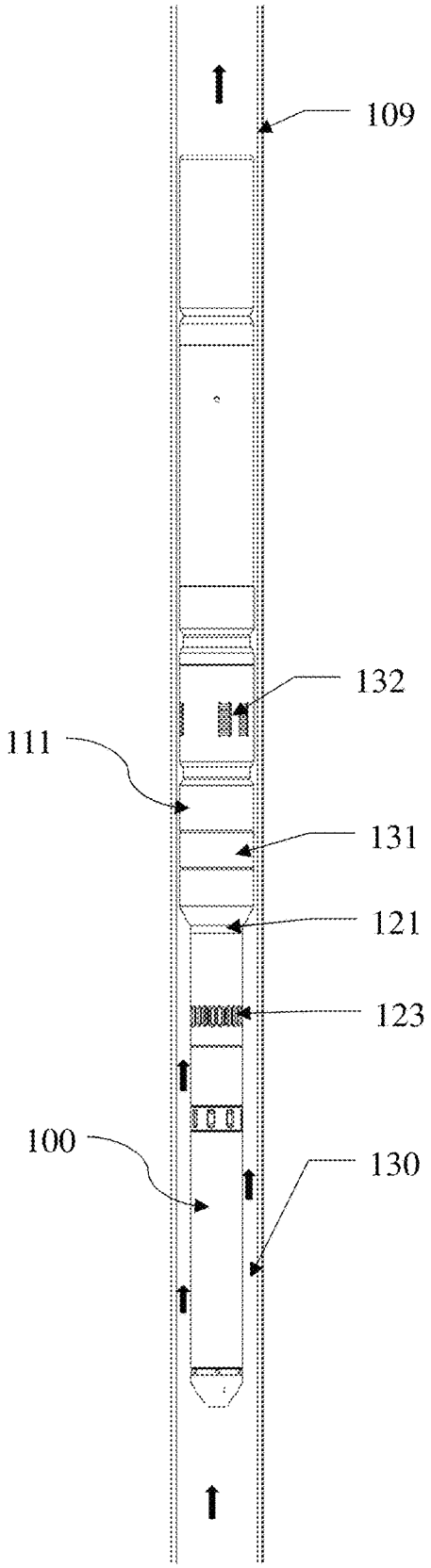
FIG. 14 illustrates an example downhole tool inside a wellbore.

FIG. 14 shows an example installation of the downhole tool 100 of FIG. 13. The downhole tool 100 can facilitate an external by-pass flow 130 for the first portion of the downhole tool 100. The inlet flow ports 123 can enable the fluid to enter the downhole tool 100 and flow through the turbine assembly before exiting the outlet flow port 121 of the downhole tool 100. The downhole tool 100 can be connected to an anchoring mechanism 111 by the threaded connection of the x-over 120 (see FIG. 13). The next tool up can be a flow-through packer, through which the flow-through fluid from the outlet flow port 121 can be communicated back in to the flow path. Flow can proceed to the production tubing 109 via an internal pathway within the flow-through packer. The outer diameter of the downhole tool 100 can advantageously be small enough to facilitate external bypass flow 130 for the first portion of the downhole tool 100. An anchoring mechanism 111 can advantageously facilitate a flow-restricting device, like a seal 131, to prevent fluid from externally bypassing the downhole tool 100. With the seal 131 in place, fluid is biased to enter the inlet flow ports 123. The anchoring mechanism 111 further facilitates an anchoring device, an example of which is illustrated here as slips 132.

Figure 16:
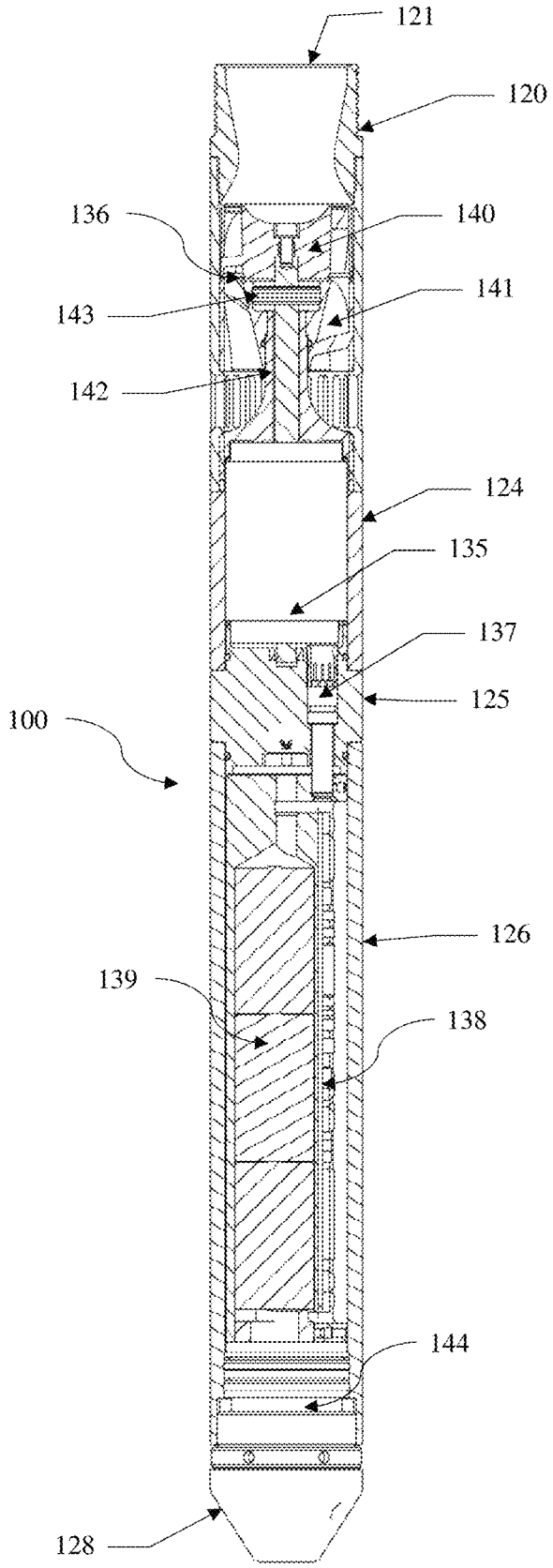
FIG. 16 is a cross-sectional view of the downhole tool of FIG. 13.

FIG. 16 shows a cross-section view of an example arrangement of components and features within the downhole tool 100 of FIG. 13. In this figure, the downhole tool 100 has a turbine assembly 136 comprising a turbine 140 and a stay vane 141. An electric generator 135 connects to the turbine 140 via the drive shaft 142, and a pressure bulkhead connector 137 facilitates an electrical connection between the electric generator 135 and the electronics assembly 138 enclosed in the electronics compartment 126. The electronics compartment 126 further encloses a battery bank 139 and a sensory system 144 housed in the nose assembly 128. The downhole tool 100 can utilize turbine-designed hydraulic machinery to couple the electric generator 135 to the fluid in the well bore. The turbine design is based on an axial flow turbine, where a guide vane, or as in the embodiment shown a stay vane 141 (stationary vane angles) spins the oncoming fluid in a rotary motion, which is then matched and harvested with the rotating turbine 140 downstream from the stay vane 141. In hydraulic machines such as turbine assemblies used from hydroelectric power production, vane angles and turbine blade angles are carefully matched to a certain revolution speed of the turbine and fluid flow to enable a matched frequency output of the electric generator to the power grid. This is often accompanied with adjustable vane angles (guide vane) and a flow control device to control the flow rate through the machine. For a downhole application as in the disclosed invention, stable flowing conditions are seldom normal, and the hydraulic machinery advantageously can perform over a large range of flowing conditions to be a viable solution. An adjustable guide vane assembly may contribute; however, an adjustable guide vane assembly contains several moving parts which can lead to mechanical failure in the harsh environment downhole. Therefore, for many applications, a stay vane design is preferred.

In some embodiments, the electric generator 135 coupled to the turbine 140 is a Permanent Magnet Generator (PMG), in which voltage output and frequency is proportional with the revolution speed. The raw 3 phase Alternating Current (AC) output from the electric generator 135 is directed into a power management system, which can be an integral part of the electronics assembly 138 and comprise a rectifier and a voltage converter (DC/DC).

Figure 15:
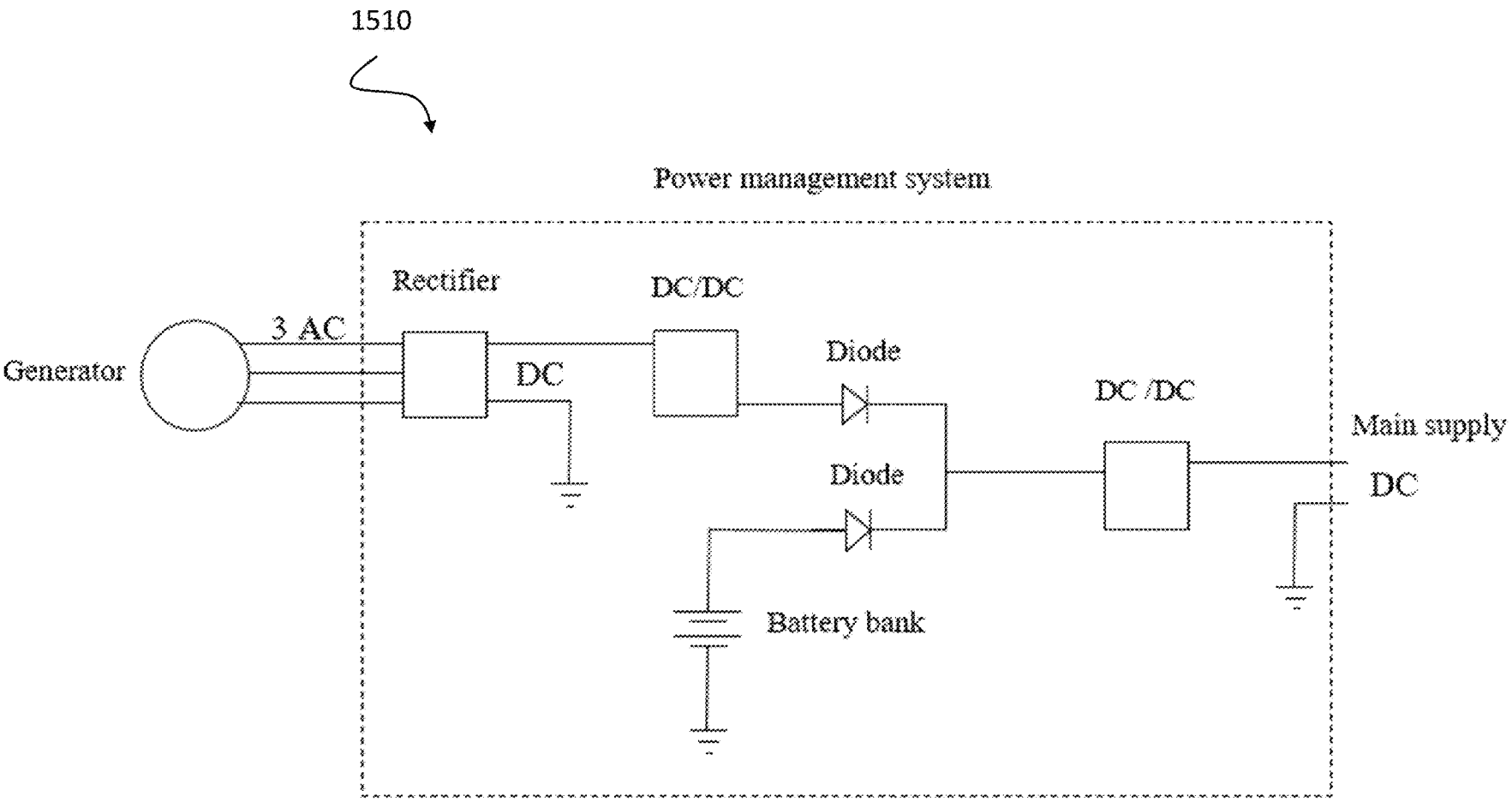
FIG. 15 is a diagram of an electric generator and power management system.

FIG. 15 shows a diagram of an electric generator and power management system 1510. The AC output from the electric generator 135 can be rectified into Direct Current (DC) and then fed into one or more DC/DC voltage regulator (s), which can step down the voltage to a stable feed voltage for the main supply. By implementation of this design, the power management system can supply steady voltage to the onboard systems from the electric generator 135 driven by the turbine 140 over a large range of flowing conditions and without the use of a complex moveable guide vane assembly.

The electric generator 135 can be encapsulated in the generator compartment 124 and protected from the harsh downhole environment. The generator compartment 124 in the embodiment shown in FIG. 16 can be a hollow member with a sealed end towards the bulkhead body 125. A non-limiting example of a material for such a hollow member is a corrosion resistant nickel alloy like Inconel Alloy 718 (Unified Numbering System N07718). The electric generator 135 can in some embodiments be fully hermetically sealed from the harsh downhole environment. In such embodiments, the mechanical torque from the turbine shaft is preferably transferred to the electric generator 135 drive shaft via a magnetic coupler. An enclosure material that has nonmagnetic properties—e.g., Inconel Alloy 718 (Unified Numbering System N07718)—is a suited material for this application. In some embodiments, the electric generator 135 can be split in two parts, the stator part containing the electrical windings, and the rotor part containing the permanent magnets on the rotor shaft, where both parts are individually hermetically sealed from the harsh downhole environment. Materials with nonmagnetic properties (such as the one identified above) are also useful for such embodiments, as these properties can enable the passage of magnetic field from the rotating magnets to the stationary electrical windings. The rotating parts are advantageously suspended in the harsh downhole environment, where one embodiment is a jewel bearing type of suspension, where the rotating part can be suspended in radially direction or axial, or both. A non-limiting example of jewel bearings materials is Sapphire, Ruby or synthetic Diamonds. Some embodiments comprise a magnetic suspension system, where the rotating parts can be magnetically suspended in a radial or axial direction, and a jewel bearing type of suspension is also used.

The electric generator 135 can be lubricated with a high temperature grade lubrication oil to lubricate the bearings and circulate heat internally to avoid thermal gradients in the electric generator 135. A non-limiting example of a high temperature grade lubrication oil is SHC 600 series from the American supplier Mobil. In the embodiment shown in FIG. 16, the electric generator 135 is connected directly to the turbine 140 via the drive shaft 142. In some embodiments, the electric generator 135 is connected to a gearbox to match the rotational speed range of the turbine 140 to the optimal rotational speed range of the electric generator 135.

The drive shaft 142 (which transfers the mechanical torque from the turbine 140 to the electric generator 135) can be sealed with a pressure-compensated rotary sealing assembly 143 to separate the internal clean lubrication fluid from the harsh well fluid outside the generator compartment 124.

The rotary sealing design can feature a single acting profile, to seal against pressures from one direction only. This design can prevent harsh downhole fluid from ingress into the generator compartment 124, while enabling pressure relief from pressure build-ups inside the generator compartment 124, due to thermal rise. The rotary sealing design can feature a double-acting profile, to seal against pressures from both directions. Acting rotary sealing design often allows the sealing friction to increase proportionally with the differential pressure, thus resulting in unwanted frictional loss and high thermal gradients in proximity to the sealing surface. High thermal loads near the sealing surface shorten the sealing assembly's service life and may introduce thermal degradation to the lubrication oil. The pressure difference between the interior and exterior of the generator compartment 124 can be reduced, in some embodiments, to mitigate or avoid the above-mentioned effects. A non-limiting example for rotary sealing materials suitable for downhole conditions is Polytetrafluoroethylene PTFE.

In some embodiments, the generator compartment 124 is pressure compensated, or equalized, to the ambient pressure outside the generator compartment 124. In the embodiment shown in FIG. 16 the pressure compensating mechanism is the pressure compensated rotary sealing assembly 143, which works as a sliding piston, equalizing the pressure forces between the outside and inside of the generator compartment 124. The pressure compensating mechanism can alternatively or additionally feature a separated floating piston inside a bore, which separates the internal clean lubrication fluid from the harsh well fluid outside the generator compartment 124. The floating piston can be made with a downhole compatible material, such as Inconel Alloy 718—depending on the material requirements for the well. The floating piston sealings can be made with a downhole compatible material, such as FFKM (perfluoro elastomer), or a similar material—depending on the material requirements for the well. Alternatively or additionally, the pressure compensating mechanism can feature a bellows which separates the internal clean lubrication fluid from the harsh well fluid outside the generator compartment 124. The bellows can be made with a downhole compatible material, such as Inconel Alloy 625 or a similar material—depending on the material requirements for the well.

The volume stroke of the compensator mechanism can advantageously be adequate for compensating the negative expansion of the lubrication oil volume when ambient pressure increases, and the positive expansion of the lubrication oil volume when temperature increases. The positive volume expansion due to elevated temperature can be found by calculating the thermal expansion of the lubrication oil, by the use of thermal expansion coefficients found in the lubrication oil datasheet, and the following equation:

$$\Delta V = V_0 \cdot \tau \cdot \Delta T$$

Where $\Delta V$ is the volume change, $V_0$ is the initial volume, $\tau$ is the thermal expansion coefficient of the fluid and $\Delta T$ is the temperature change.

The negative volume expansion due to elevated pressure can be found by applying the bulk modulus formula for the lubrication oil, which can be found in the lubrication oil datasheet, or by measurements. The relationship between volume and pressure is expressed by the following equation:

$$\Delta V = -\frac{\Delta p}{B} V_0$$

Where $\Delta V$ is the volume change, $V_0$ is the initial volume, B is the bulk modulus of the fluid and $\Delta p$ is the pressure change.

The power output from the electric generator 135 housed in the generator compartment 124 can be connected to a pressure bulkhead connector 137 which separates the pressure compensated generator compartment 124 from the electronics compartment 126. A non-limiting example of suppliers for such pressure bulkheads connectors is the American supplier "KEMLON".

FIG. 16 also illustrates that the electronics assembly 138, battery bank 139 and sensory system 144 can be enclosed in an atmospheric pressure chamber, here shown as the electronics compartment 126, to protect the components from the elevated pressures associated with harsh downhole environment. The load controller system can dissipate large amounts of heat when inducing the perturbation load on the electric generator 135. One method of packing and enclosing downhole electronics is by a potting agent like epoxy or similar material, to prevent vibration and shock damages to the electric circuits. However, for thermal management and heat conduction, this method often will not suffice, and other measures may be implemented. In some embodiments, the load controller system is mounted on a heat-conducting material which enables heat conduction to the exterior body of the downhole tool, shown as the electronics compartment 126 in the example view FIG. 16. The exterior of the downhole tool 100 can be cooled by the by-passing fluid seen in FIG. 14. In some embodiments, the pressure chamber can be filled with a dielectric fluid with high thermal conductivity properties. This fluid can circulate and distribute heat away from the electronic circuits by convection. A non-limiting example of such electronic fluid is Fluorinert FC-43 by the American supplier 3M. In some embodiments, a combination of the above features can be used.

The downhole tool 100 facilitates a turbine 140 driven electric generator 135 coupled to the fluid in the well 103. The turbine 140 can spin proportionally with the flow rate of the moving fluid, thus as a flow measurement device, the free-running turbine can measure the flow rate by monitoring the turbine 140 revolutions and comparing the measured revolution speed to a calibrated value. The relation of flow vs turbine 140 rpm can be expressed mathematically as:

$$Q = RPM_{Turbine} \cdot K$$

Where flow is represented by Q, and K is a calibration factor acquired by flow testing. The flow measurement can be implanted as a sensor measurement value. See the discussion of the onboard measurement system in the text describing FIG. 6, for example. If a flow rate is calculated or determined from existing turbine operation data, the communication approaches disclosed herein can be used to transmit the flow rate for use elsewhere in a well environment or industry. Thus, a useful advantage is to facilitate communication between a downhole tool and a surface station. Other advantages are facilitating communication between multiple downhole tools. Even if flow sensor data is already available, it can be very helpful to obtain corroborating data, data from a different well depth, etc. Redundant and/or independent systems and measurements are often very useful for a well.

The downhole tool can use the flowing fluid to power its onboard systems like the sensory system 144, electronics assembly 138 and recharge a rechargeable battery bank 139 (among others) by harvesting electric energy from the electric generator 135 coupled to the turbine 140. In order to charge the rechargeable batteries in the battery bank 139, a Battery Management System (BMS) may be used to monitor and control the charging current and battery voltage levels. Commercially available circuits can be used for this process. The rechargeable batteries can power a limited number of, or all, systems in the downhole tool 100 during a well 103 shut-in period. Rechargeable high temperature batteries for downhole applications may be of limited commercial availability, however suppliers such as SAFT claim to have Lithium-ion available downhole applications. The downhole tool can use primary batteries to power a limited number of, or all, systems in the downhole tool during a well 103 shut-in period. A non-limiting example high temperature primary battery can use Lithium Thionyl Chloride cells and a potential supplier is the German based company "TADIRAN". In both above-mentioned embodiments, the power management system (see FIG. 15) can use an Uninterrupted Power Supply (UPS) circuit to ensure adequate voltage supply to enable continuous operation of the onboard systems of the downhole tool 100. The UPS is designed such that the voltage supply from the electric generator 135 and the battery bank 139 voltage supply are both feed-through diodes (see FIG. 15). Arranged in this way, the main supply voltage can avoid dropping below the lowest supply voltage, e.g., the battery bank 139, and when the electric generator 135 produces higher voltages than the battery bank 139, the main supply draws current from the electric generator 135, preserving the battery bank 139.

The downhole tool can further be programmed to sense and capture certain reservoir 107 conditions during a well 103 shut-in period. Signals reflecting these conditions can be transmitted to surface 102 when the well 103 is started up again, or the downhole tool 100 is retrieved to surface 102.

Additional Communication Options

In some embodiments, the downhole tool 100 can facilitate a decoding system for signal receptions from other remotely installed downhole tools 100 and/or from the surface 102 or subsea location. The downhole tool 100 can use the electric generator 135 revolution speed (e.g., output such as signals and/or sounds resulting therefrom) as a sensory input to receive perturbation 113 signals from another location. The electric generator 135 revolution speed can be monitored by a sensor to measure the voltage frequency output from the machine, or if a PMG electric generator 135 is used, another type of sensor can be used to monitor the voltage output from the PMG as the voltage output can be generally proportional to the revolution speed. Alternatively or additionally, the downhole tool 100 can use a pressure sensor to receive perturbation signals 113 from another location.

The decoding system can be set to listen to the chosen baseband frequency and monitor the phase angle shift which corresponds to the chosen number of periods set forth in the wireless communication protocol for MPBPSK. In some cases, the decoder may be set to listen to the two chosen baseband frequencies and monitor the shift between the frequencies (e.g., when MPBFSK is used).

Disclosed Embodiments

Disclosed embodiments include a wireless gauge system for use in a downhole well. The system can comprise: a downhole tool configured to hang from a wellbore anchoring mechanism installable with at least one of the following methods: slickline, wireline, coiled tubing, and tubing deployed. The tool can comprise one or more of the following: an energy harvesting system, a power management system (which can optionally include an energy storing system), a sensor-based sensing system, and/or a first wireless communication system. The system can further comprise a receiver station configured to be positioned closer than the downhole tool to a well operator position. The first wireless communication system can be configured to use as signals perturbations that comprise disruptions in the flow of fluid in a flowing well (e.g., production well, injector well, etc.) such that perturbation signals are encoded in changes of hydraulic energy of the fluid flow, including in flow changes, pressure changes, or a combination of flow and pressure changes. The first wireless communication system can be configured to use perturbations that propagate at least partially through fluid in an annulus. The receiver station can have a sensing system configured to receive wireless signals from the downhole tool. The power management system can optionally include battery storage, for example.

The receiver station described above can create perturbation signals by applying time-varying electric load changes to a turbine generator system, for example. Tools configured to transmit such signals can be located downhole, at the surface, or at a subsea location. The receiver station described above can have an energy harvesting system, a power management and storing system; and a second wireless communication system. The receiver station described above can have first and second wireless communication systems that are configured to use perturbations that propagate at least partially through fluid in an annulus, where the annulus does not have direct fluid communication with a downhole component of the wireless communication system and signal is transferred to the annulus via the expansion and/or compression of the inner tube by the fluid perturbations inside it. The first and second wireless communication systems can be configured to use at least one signal processing protocol selected from the group consisting of BFSK, MPBFSK, BPSK, and MBPSK. The second wireless communication system can be configured to accumulate signal energy in the channel to address noise and enhance accuracy of resulting output under unstable conditions. The first and second wireless communication systems can use use multiple periods per bit to accumulate more energy in a given channel. The wellbore anchoring mechanism can comprise a mechanism selected from the group consisting of: a lock mandrel, a gauge hanger, and a flow-through plug. The second wireless communications system can be further configured to relay signals to a remote location comprising a secure server or a Supervisory Control And Data Acquisition (SCADA) system.

Also disclosed is a method of measuring reservoir and fluid conditions related to a well bore. The method can comprise installing a downhole tool at a downhole location in the well bore. A tool can be used to measure reservoir and fluid conditions and create measurements. The measurements can be processed and stored at the downhole location (e.g., in a local memory). The method can encode the measurements into a data record using a wireless communication protocol. It can establish a data record from the downhole measurements by assembling and synchronizing head, payload, and tail bit patterns. The tail bit pattern can comprise a checksum validation bit pattern. The method can transmit the data record by using a transmitter (e.g., a downhole tool, a turbine generator, etc.) to induce perturbations in a fluid environment within at least one tube or borehole. The tube can comprise a production line, an annulus, or both. Energy signals can transfer between an outer wall of production tubing and an inner wall of a surrounding casing string to pass from a production line to an annulus in an effective transmission zone or area. At a surface receiver station, the method can use a pressure sensor (e.g., a dynamic sensor) in fluid communication with an annulus pressure port to acquire pressure signals comprising the data record. It can decode pressure signals using selected baseband characteristics from the transmitter (e.g., downhole tool) to reveal the transmitted data record. It can store the transmitted data record in a memory of the surface receiver, thereby facilitating further analysis and display to a user at the surface receiver. It can also relay data from the transmitted data record to a remote server for use by a remotely-located end user, for example. The annulus can be filled with a diesel or brine fluid.

The downhole tool can be a turbine generator. In some embodiments, the downhole tool can be located near, draw energy from, and/or facilitate a generator. The method can further comprise determining an effective transmission zone where the production tubing and annulus overlap below a noise zone (which can begin at or otherwise be associated with a bubble point) and using the length of that zone to select an adequate, improved, or optimal baseband signal for the perturbations. In some methods, the baseband can be selected or configured such that the half wavelength (or a multiple of the half wavelength) of each perturbation corresponds to the length of a noise zone and thereby enhances signal energy transfer. The effective transmission area can be used to establish a baseband signal for the perturbations such that the half wavelength (or a multiple of the half wavelength) of each perturbation fully covers the distance from the depth of a lower annulus volume constraint to the depth (or expected depth) of the noise zone. The method can relay the data record to a remote location using a wireless system selected from the group comprising: WIFI, GSM, Iridium satellite, radio communication. The method can use a downhole energy recovery device configured to use flowing fluid to power at least one of a sensory system or an electronics assembly. It can optionally use fluid energy to power a rechargeable battery bank, for example. In the method, processing the measurements, storing them, and encoding them into data can be performed by a sensory system, an electronics assembly, and a rechargeable battery bank, each located in a downhole location. The method can further comprise using a downhole energy recovery device configured to use flowing fluid to power at least one of the sensory system, the electronics assembly, and the rechargeable battery bank.

Disclosed is a method of controlling a downhole tool with wireless command signals. The method can comprise using a turbine generator to establish perturbation signals in flowing fluid (e.g., production fluid or water, for example) of a flowline that extends to the surface of a wellbore, the perturbation signals comprising command information. It can include using a pressure sensor or energy recovery device in fluid communication with the flowline to receive the perturbation signals at a downhole tool located at first downhole location in the flowline of the wellbore. It can include using a predetermined protocol and baseband characteristics to decode the perturbation signals and reveal the transmitted command information. It can also include, after decoding, providing the command information to the downhole tool for execution, thereby establishing wireless control of the downhole tool at the first downhole location. In the method, one or more of the downhole tools can be an energy recovery device configured to harness energy from flowing fluid.

The method can include wirelessly receiving and relaying signals from one downhole location (e.g., a downhole tool and/or an energy recovery device such as a turbine and generator) to another. This can be done by, after receiving the perturbation signals using the pressure sensor at the first downhole location, using the energy recovery device to relay said received perturbation signals toward a second downhole location by establishing relay perturbation signals. The method can further comprise receiving and relaying signals between two downhole tools at first and second downhole locations by receiving and transmitting perturbation signals at two separate baseband frequencies, enabling duplex communication.

The disclosure includes a long-distance communication apparatus configured for use in a well, which can have a transmitter configured to create long-distance signals comprising perturbations in pressure waves and cause these signals to propagate through a primary pathway in a well. It can also have a controller configured to interact with the transmitter to cause it to organize the long-distance signals according to a long-distance signal protocol. It can also have an induced signal apparatus configured for placement prior to (e.g., on the source side of or on the transmitter side of) a noise zone (e.g., such as below a bubble point if signals are being propagated upward past the bubble point) within the primary pathway of the well to allow long-distance signals (e.g., upward-bound signals) to transfer to a secondary pathway in the same well, thereby bypassing attenuation that occurs in the noise zone (e.g., at or after the bubble point). It can also have a sensor (e.g., on the opposite side of the noise zone) configured to receive and record the long-distance signals that arrive via the secondary pathway. Signals can therefore effectively bypass a signal impediment or noise zone. It can also have a receiver having access to the long-distance signal protocol and configured to decode the long-distance signals. At least a portion of a noise zone can correspond to a bubble point in a production well. The secondary pathway can comprise a nonflowing annulus (or relatively static fluid in a non-flowing open well bore) surrounding the primary pathway of the well. At least a portion of the noise zone can correspond to the location of a downhole tool or flow disruptions caused thereby. The downhole tool can be one or more of an Electrical Submersible Pump, a Progressive Cavity Pump, and artificial lift devices such as sucker rod pumps or gas lifts, for example.

To facilitate communication, the controller can be configured to cause the transmitter to repeat long-distance signals multiple times as part of the long-distance signal protocol and the sensor can be configured to sense the repeated signals and allow them to accumulate signal energy and improve a signal to noise ratio. They may also accumulate for a sufficient time to improve accuracy and resolution of transmitted information. The apparatus can comprise a down-hole tool, the primary pathway can comprise production tubing, and the secondary pathway can comprise an annulus surrounding the production tubing along a portion thereof (e.g., toward or away from the surface). The transmitter can be configured to emit a base-band signal. The induced signal apparatus can be or include a packer that establishes a lower bound for the annulus volume. The packer can be positioned at a distance below a signal impediment or noise zone (which can correspond, for example to the bubble point) that is equal to or greater than half wavelength of the baseband signal to facilitate translation of secondary signals into the secondary pathway. The method can further comprise using perturbations in one tube (e.g., a flowline in production tubing) to induce corresponding perturbations in the fluid of an annulus such that signal transfer occurs through an outer wall of production tubing and the inner wall of a surrounding casing string.

The disclosure includes a method of communication from a down-hole well location to a remote receiver. The method can include one or more of the following steps and/or acts. After an estimated or measured noise zone (e.g., relating to a bubble point) in a flow line has been determined, an annulus can be established surrounding the flow line such that a portion of the annulus extends below the noise zone to create a signal inducement transfer zone. The signal transfer zone can have a length. The method can propagate primary perturbation signals in the flow line from below the annulus, and the primary perturbation signals can have at least two distinct wavelengths, including a baseband wavelength. A baseband wavelength can be configured to be compatible with a length of the signal transfer zone by establishing a baseband wavelength that is a multiple of (or is divisible by) the length of such a zone. It can be helpful to measure or otherwise determine the length or other physical properties of such a zone and use those properties to enhance signal propagation. Wavelengths can be selected, enhanced, or optimized based on the length of a transfer zone. For example, in some embodiments, a baseband wavelength can be a low multiple (e.g., no more than ten times or no more than four times the length of) the signal transfer zone. The method can propagate the primary perturbation signals using a transmission protocol that repeats perturbation signals over several periods. The method can measure induced perturbation signals in the annulus according to a complimentary protocol that accumulates signal energy in the channel for each bit and allows the underlying data to achieve higher resolution and transmission success over time.

The disclosure includes a method of improving wireless gauge communication from a down-hole well position. The method can comprising one or more of the following steps or acts. It can determine an induced signal transfer zone length by determining a vertical distance between a lower end of a well's annulus and a noise zone (e.g., which may have a general lower boundary at or near the bubble point) of a well's flow line. It can control a signal source to propagate baseband and frequency signals that have wavelengths compatible with the transfer zone length, thereby enhancing induced signal transfer and improving communication results. It can repeat portions of the signals from the signal source to allow a receiver to repeatedly receive a version of the same transmission and use the repetition to correct, confirm, or accumulate information regarding the received signal, thereby improving accuracy, confidence in, and resolution of the received signal.

The disclosure includes a method of improving communication using a signal transfer zone of a well. The method can include one or more of the following steps or acts. It can determine a signal impediment or noise zone (e.g., bubble point, etc.) depth within a well. It can deploy a downhole tool at a known depth within the well. It can propagate primary signals through tubing (e.g, production tubing or injection tubing) of the well from the downhole tool to an annulus. It can cause the primary signals to induce secondary signals in the annulus vertically below the signal impediment (e.g., noise zone or bubble point) depth. It can sense the secondary signals in the annulus above the bubble point depth. A signal impediment can comprise a noise zone resulting from multiphase flow above a bubble point. A signal impediment can also or alternatively comprise a downhole tool. Downhole tools that can correspond to signal impediments can include Electrical Submersible Pumps, Progressive Cavity Pumps, and artificial lift devices such as sucker rod pumps or gas lifts. The method can further comprise optimizing signal transfer by adjusting, or by selecting communication frequencies for compatibility with, a distance between a lower extremity of the annulus and the signal impediment.

Reference throughout this specification to "some embodiments" or "an embodiment" means that a particular feature, structure or characteristic described in connection with the embodiment is included in at least some embodiments. Thus, appearances of the phrases "in some embodiments" or "in an embodiment" in various places throughout this specification are not necessarily all referring to the same embodiment and may refer to one or more of the same or different embodiments. Furthermore, the particular features, structures or characteristics can be combined in any suitable manner, as would be apparent to one of ordinary skill in the art from this disclosure, in one or more embodiments.

As used in this application, the terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Similarly, it should be appreciated that in the above description of embodiments, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, inventive aspects lie in a combination of fewer than all features of any single foregoing disclosed embodiment.

Embodiments of the disclosed systems and methods can be used and/or implemented with local and/or remote devices, components, and/or modules. The term "remote" may include devices, components, and/or modules not stored locally. Thus, a remote device may include a device which is physically located in the same general area and connected via a device such as a switch or a local area network. In other situations, a remote device may also be located in a separate geographic area, such as, for example, in a different location, building, city, country, and so forth.

Methods and processes described herein may be embodied in, and partially or fully automated via, software code modules executed by one or more general and/or special purpose computers. The word "module" refers to logic embodied in hardware and/or firmware, or to a collection of software instructions, possibly having entry and exit points, written in a programming language, such as, for example, C or C++. A software module may be compiled and linked into an executable program, installed in a dynamically linked library, or may be written in an interpreted programming language such as, for example, BASIC, Perl, or Python. It will be appreciated that software modules may be callable from other modules or from themselves, and/or may be invoked in response to detected events or interrupts. Software instructions may be embedded in firmware, such as an erasable programmable read-only memory (EPROM). It will be further appreciated that hardware modules may be comprised of connected logic units, such as gates and flip-flops, and/or may be comprised of programmable units, such as programmable gate arrays, application specific integrated circuits, and/or processors. The modules described herein are preferably implemented as software modules, but may be represented in hardware and/or firmware. Moreover, although in some embodiments a module may be separately compiled, in some embodiments a module may represent a subset of instructions of a separately compiled program, and may not have an interface available to other logical program units.

In certain embodiments, code modules may be implemented and/or stored in any type of computer-readable medium or other computer storage device. In some systems, data (and/or metadata) input to the system, data generated by the system, and/or data used by the system can be stored in any type of computer data repository, such as a relational database and/or flat file system. Any of the systems, methods, and processes described herein may include an interface configured to permit interaction with patients, health care practitioners, administrators, other systems, components, programs, and so forth.

A number of applications, publications, and external documents may be incorporated by reference herein. Any conflict or contradiction between a statement in the body text of this specification and a statement in any of the incorporated documents is to be resolved in favor of the statement in the body text.

Although described in the illustrative context of certain preferred embodiments and examples, it will be understood by those skilled in the art that the disclosure extends beyond the specifically described embodiments to other alternative embodiments and/or uses and obvious modifications and equivalents. Thus, it is intended that the scope of the claims which follow should not be limited by the particular embodiments described above.

What is claimed is:

1. A long-distance communication apparatus configured for use in a well, the apparatus comprising:

a transmitter configured to create long-distance signals comprising perturbations in pressure waves and cause the long-distance signals to propagate through a primary pathway in a well;

a controller configured to interact with the transmitter to cause it to organize the long-distance signals according to a long-distance signal protocol;

an induced signal apparatus configured for placement on transmitter side of a noise zone within the primary pathway in the well to allow the long-distance signals to transfer to a secondary pathway in the well, thereby bypassing attenuation that occurs in the noise zone;

a sensor on opposite side of the noise zone and configured to receive and record the long-distance signals that arrive via the secondary pathway; and a receiver having access to the long-distance signal protocol and configured to decode the long-distance signals.

2. The apparatus of claim 1, wherein at least a portion of the noise zone corresponds to a bubble point in a production well and the secondary pathway comprises a nonflowing annulus surrounding the primary pathway of the well.

3. The apparatus of claim 1, wherein at least a portion of the noise zone corresponds to at least one downhole tool selected from the group consisting of Electrical Submersible Pumps, Progressive Cavity Pumps, and artificial lift devices such as sucker rod pumps or gas lifts.

4. The apparatus of claim 1, wherein to facilitate communication, the controller is configured to cause the transmitter to repeat long-distance signals multiple times as part of the long-distance signal protocol and the sensor is configured to sense the repeated signals and allow them to accumulate the repeated signal energy and improve a signal to noise ratio.

5. The apparatus of claim 4, wherein the transmitter comprises a down-hole tool, the primary pathway comprises production tubing, and the secondary pathway comprises an annulus surrounding the production tubing along a portion thereof.

6. The apparatus of claim 1, wherein the transmitter is configured to emit a base-band signal, the induced signal apparatus comprises a packer that establishes a lower bound for the annulus volume, and the packer is positioned at a distance below the noise zone that is equal to or greater than half wavelength of the baseband signal to facilitate translation of secondary signals into the secondary pathway.

7. A method of improving communication using a signal transfer zone of a well, the method comprising:

determining a signal impediment depth of a well;

deploying a downhole tool at a known depth within the well;

propagating primary signals through tubing of the well from the downhole tool to an annulus;

causing the primary signals to induce secondary signals in the annulus below the signal impediment depth of the well; and sensing the secondary signals in the annulus above the signal impediment depth.

8. The method of claim 7, wherein the signal impediment comprises a noise zone resulting from multiphase flow above a bubble point.

9. The method of claim 7, wherein the signal impediment comprises at least one downhole tool selected from the group consisting of Electrical Submersible Pumps, Progressive Cavity Pumps, and artificial lift devices such as sucker rod pumps or gas lifts.

10. The method of claim 7, further comprising optimizing signal transfer by adjusting, or by selecting communication frequencies for compatibility with, a distance between a lower extremity of the annulus and the signal impediment.

11. A wireless communication system for use in a downhole well, the system comprising:

a downhole tool configured to hang from a wellbore anchoring mechanism; and a receiver station configured to be positioned closer than the downhole tool to a well operator position, the receiver station comprising a high noise sensing system configured to receive wireless signals from the downhole tool;

wherein the wireless communication system is configured to use, as fluid flow perturbation signals, perturbations that comprise disruptions in flow of fluid in a flowing well such that the fluid flow perturbation signals are encoded in changes of hydraulic energy of the flow of the fluid, including in flow changes, pressure changes, or a combination of flow and pressure changes; and the wireless communication system configured to propagate and receive signals through more than one medium and despite lack of fluid continuity by using signal induction to transfer signal energy between downhole fluid and solid pipe;

the system further configured for long-distance communication despite the signals being relatively weak compared to environmental noise conditions by persistently sensing a repeated signal, using timing and periodicity to accumulate energy in a particular channel, thereby transmitting and receiving the signals through noise.

12. The wireless communication system of claim 11, further comprising a transmission system for transmitting perturbation signals to at least one downhole tool through at least an annulus section of the flowing well.

13. The wireless communication system of claim 11, wherein the system is configured for controlling a downhole tool with wireless command signals by:

establishing perturbation signals in flowing fluid of a flow line that extends to the surface of a wellbore, the perturbation signals comprising command information;

using a pressure sensor or energy recovery device in fluid communication with the flow line to receive perturbation signals at the downhole tool;

using a predetermined protocol and baseband characteristics to decode the perturbation signals and reveal the transmitted command information; and after decoding, providing the command information to the downhole tool for execution, thereby establishing wireless control of the downhole tool.

14. A communication system comprising:

a downhole tool configured to hang from a wellbore anchoring mechanism; and a receiver station configured to be positioned between the downhole tool and a surface well operator position, the receiver station comprising a sensing system configured to receive wireless signals from the downhole tool despite high noise using perturbations that comprise disruptions in well fluid such that fluid flow perturbation signals are encoded in changes of hydraulic energy in the well fluid, including in flow changes, pressure changes, or a combination of flow and pressure changes;

the wireless communication system configured to propagate and receive signals through multiple media without fluid continuity such that signals are induced and thereby transfer from a primary pathway in a noisy multi-phase production fluid conduit to a secondary pathway comprising an annulus having less noise than the noisy multi-phase production fluid conduit;

the system further configured for long-distance communication in extreme downhole noise conditions by persistently sensing a repeated signal, using timing and periodicity to accumulate energy in a particular channel and extracting the signals from noise.

15. The system of claim 14, wherein the annulus contains single-phase fluid that flows in a more uniform manner and has more uniform density than the production fluid, which contains multi-phase fluid with turbulent, non-uniform flow and density properties.

16. The system of claim 15, wherein the annulus contains relatively static fluid as compared to the dynamic production fluid.

17. The communication system of claim 14, further comprising a transmission system for transmitting the perturbation signals to at least one downhole tool through at least an annulus section of the flowing well.

18. The communication system of claim 14, wherein the system is configured for controlling a downhole tool with wireless command signals by:

establishing perturbation signals comprising command information in fluid of a flow line that extends to the surface of a wellbore;

using a receiver in fluid communication with the flow line to receive perturbation signals at the downhole tool;

using a predetermined protocol and baseband characteristics to decode the perturbation signals and reveal the transmitted command information; and after decoding, provide the command information to the downhole tool for execution, thereby establishing control of the downhole tool.

19. A wireless gauge system for use in a downhole well, the system comprising:

a downhole tool configured to hang from a wellbore anchoring mechanism; and a receiver station comprising a sensing system;

the wireless gauge system configured to:

use as signals, perturbations that comprise disruptions in flow of fluid through a primary pathway in a flowing well such that perturbation signals are encoded in changes of hydraulic energy of the flow of the fluid, including in flow changes, pressure changes, or a combination of flow and pressure changes in the primary pathway, the primary pathway having at least one noise zone; and use signal induction into a secondary pathway, comprising an annulus that surrounds the primary pathway and is less noisy than the noise zone, to bypass the noise zone.

20. The system of claim 19, wherein the downhole tool comprises a signal source and the system:

propagates primary signals from the signal source through production fluid;

uses those primary signals to induce secondary signals through a rigid wall in the well such that secondary signals propagate through the annulus; and uses the sensing system to receive information transmitted using the primary and secondary signals.

21. The system of claim 19, wherein the system establishes induced secondary signals in the annulus fluid outside a production pipe by propagating primary signals in parallel inside the production pipe by a length corresponding to at least one half wavelength of a baseband signal.

22. The system of claim 19, wherein at least a portion of the noise zone corresponds to at least one downhole tool selected from the group consisting of Electrical Submersible Pumps, Progressive Cavity Pumps, and artificial lift devices such as sucker rod pumps or gas lifts.

23. The system of claim 19, wherein the transmitter is configured to emit a base-band signal, the induced signal apparatus comprises a packer that establishes a lower bound for the annulus volume, and the packer is positioned at a distance below the noise zone that is equal to or greater than half wavelength of the baseband signal to facilitate translation of secondary signals into the secondary pathway.

* * * * *